US010640899B2

(12) United States Patent
Lee

(10) Patent No.: US 10,640,899 B2
(45) Date of Patent: May 5, 2020

(54) BLEACHING AND SHIVE REDUCTION PROCESS FOR NON-WOOD FIBERS

(71) Applicant: GPCP IP Holdings LLC, Atlanta, GA (US)

(72) Inventor: Jeffrey A. Lee, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 726 days.

(21) Appl. No.: 14/716,211

(22) Filed: May 19, 2015

(65) Prior Publication Data

US 2015/0337485 A1 Nov. 26, 2015

Related U.S. Application Data

(60) Provisional application No. 62/000,837, filed on May 20, 2014.

(51) Int. Cl.

| | |
|---|---|
| ***D04H 1/492*** | (2012.01) |
| ***D04H 1/42*** | (2012.01) |
| ***D06L 4/30*** | (2017.01) |
| ***D06L 4/13*** | (2017.01) |

(52) U.S. Cl.

CPC ..... *D04H 1/492* (2013.01); *D04H 1/42* (2013.01); *D06L 4/13* (2017.01); *D06L 4/30* (2017.01)

(58) Field of Classification Search

CPC . D04H 1/42; D04H 1/492; D06L 4/60; D06L 4/614; D06L 4/657; D06L 4/30; D06L 4/13

See application file for complete search history.

(56) References Cited

U.S. PATENT DOCUMENTS

| | | | | |
|---|---|---|---|---|
| 797,749 | A | 8/1905 | Robinson et al. | |
| 1,908,481 | A | 5/1933 | Kauffmann | |
| 2,018,276 | A * | 10/1935 | McKee | D01C 1/02 162/9 |
| 2,174,178 | A | 9/1939 | Nichols | |
| 2,407,227 | A | 11/1943 | Earle | |
| 2,469,249 | A | 5/1949 | Vincent et al. | |
| 3,193,445 | A | 7/1965 | Parker et al. | |
| 3,384,444 | A * | 5/1968 | Simpson | D06L 4/30 8/111 |
| 3,472,609 | A * | 10/1969 | Burr | D06L 4/30 8/107 |
| 3,485,706 | A | 12/1969 | Evans | |
| 3,661,699 | A | 5/1972 | Edward | |
| 3,775,055 | A | 11/1973 | Wedler | |
| 4,014,635 | A | 3/1977 | Kroyer | |
| 4,033,811 | A | 7/1977 | Gloersen | |
| 4,363,697 | A | 12/1982 | Markham et al. | |
| 4,416,548 | A | 11/1983 | Carre et al. | |
| 4,640,810 | A | 2/1987 | Laursen et al. | |
| 4,756,798 | A | 7/1988 | Lachenal et al. | |
| 4,795,476 | A | 1/1989 | Bean et al. | |
| 5,205,835 | A | 4/1993 | Tieckelmann et al. | |
| 5,244,466 | A | 9/1993 | Litz et al. | |
| 5,409,570 | A | 4/1995 | Griggs et al. | |
| 5,683,794 | A | 11/1997 | Wadsworth et al. | |
| 5,695,868 | A | 12/1997 | McCormack | |
| 5,888,352 | A | 3/1999 | Yoshikawa et al. | |
| 5,958,186 | A | 9/1999 | Holm et al. | |
| 6,083,739 | A | 7/2000 | Franks | |
| 6,136,041 | A | 10/2000 | Jaschinski et al. | |
| 6,258,207 | B1 | 7/2001 | Pan | |
| 6,302,997 | B1 | 10/2001 | Hurter et al. | |
| 6,514,380 | B1 | 2/2003 | Laine | |
| 6,524,348 | B1 | 2/2003 | Jewell et al. | |
| 6,569,286 | B1 | 5/2003 | Withenshaw et al. | |
| 7,044,985 | B2 | 5/2006 | Rizzardi et al. | |
| 7,481,843 | B2 | 1/2009 | Xu | |
| 7,932,196 | B2 | 4/2011 | McCormack et al. | |
| 8,591,701 | B2 | 11/2013 | Sung et al. | |
| 8,603,802 | B2 | 12/2013 | Sung et al. | |
| 2002/0098317 | A1 | 7/2002 | Jaschinski et al. | |
| 2002/0155281 | A1 * | 10/2002 | Lang | A61K 8/0208 428/337 |
| 2003/0226209 | A1 | 12/2003 | Fuminori | |
| 2004/0121158 | A1 * | 6/2004 | Shannon | D21H 17/53 428/413 |
| 2004/0163779 | A1 | 8/2004 | Pan | |
| 2004/0256065 | A1 | 12/2004 | Ahmed et al. | |

(Continued)

FOREIGN PATENT DOCUMENTS

| | | | |
|---|---|---|---|
| CA | 841938 | A | 5/1970 |
| CA | 2745606 | A1 | 7/2010 |

(Continued)

OTHER PUBLICATIONS

European Supplementary Search Report, Communication dated Nov. 20, 2017, Application No./Patent No. 15796315.8-1308 / 3146108 PCT/US2015031553, pp. 9.

Harwood, Ray, et al.; "Cottonisation of Flax"; 2008 International Conference on Flax and Other Bast Plants; p. 118-128; 2008.

Lystad, Elizabeth; "TCF-Bleaching of Softwood Chemical Pulps with Permanganate"; International Pulp Bleaching Conference; p. 357-370; 1996.

International Search Report and Written Opinion dated Aug. 11, 2015 for PCT/US2015/031553.

International Search Report and Written Opinion dated Jul. 21, 2015 for PCT/US2015/031551.

International Search Report and Written Opinion dated Jul. 21, 2015 for PCT/US2015/031557.

(Continued)

*Primary Examiner* — Amina S Khan

(57) ABSTRACT

The present invention is directed to a method of increasing the brightness of non-wood fibers. The method comprises forming a mixture of non-wood fibers and exposing the mixture to a brightening agent, the brightening agent being a permanganate compound, an acid, or a combination of the permanganate compound and the acid. The resulting brightened fibers have a brightness greater than the fibers of the mixture before exposure as measured by MacBeth UV-C standard.

46 Claims, 12 Drawing Sheets

(56) References Cited

U.S. PATENT DOCUMENTS

| | | | |
|---|---|---|---|
| 2006/0183816 | A1 | 8/2006 | Gelman et al. |
| 2007/0272378 | A1 | 11/2007 | Paren et al. |
| 2010/0139877 | A1 | 6/2010 | Black et al. |
| 2011/0114273 | A1 | 5/2011 | Yaqoob et al. |
| 2013/0276246 | A1 | 10/2013 | Bellini |
| 2014/0066872 | A1 | 3/2014 | Baer et al. |

FOREIGN PATENT DOCUMENTS

| | | | | | |
|---|---|---|---|---|---|
| CN | 86103060 | A | | 4/1987 | |
| CN | 1072746 | A | | 6/1993 | |
| CN | 1355338 | | * | 6/2002 | ..... D02G 3/02 |
| CN | 101215776 | A | | 7/2008 | |
| CN | 102086533 | | * | 6/2011 | ..... D01C 1/02 |
| CN | 103243599 | A | | 8/2013 | |
| CN | 103266519 | A | | 8/2013 | |
| DE | 10114341 | A1 | | 10/2002 | |
| EP | 0206560 | A2 | | 12/1986 | |
| EP | 0408199 | A1 | | 6/1990 | |
| EP | 0526383 | A1 | | 3/1993 | |
| EP | 931862 | A1 | | 7/1999 | |
| EP | 0931862 | A1 | | 7/1999 | |
| EP | 1780316 | A2 | | 2/2007 | |
| EP | 1780316 | A2 | | 5/2007 | |
| GB | 412470 | A | | 6/1934 | |
| JP | 2002363878 | A | | 12/2002 | |
| JP | 2008013859 | A | | 1/2008 | |
| WO | 9710100 | A1 | | 3/1997 | |
| WO | 9826808 | A2 | | 6/1998 | |
| WO | 9937834 | A | | 7/1999 | |
| WO | 9954544 | A1 | | 10/1999 | |
| WO | 0012810 | A1 | | 3/2000 | |
| WO | 0116423 | A1 | | 8/2001 | |
| WO | 0246522 | A2 | | 6/2002 | |
| WO | 2005025865 | A1 | | 3/2005 | |
| WO | 2007140578 | A1 | | 12/2007 | |
| WO | 2008105603 | A1 | | 9/2008 | |
| WO | 2013033405 | A1 | | 3/2013 | |

OTHER PUBLICATIONS

Mortazavi, S. M., et al.; "Evaluating Simultaneous Desizing and Bleaching of Greige Cotton Fabric Using KMnO4"; Textiel Research Journal; vol. 78, No. 6; p. 497-501; 2008.

Hietanan, Tomi M., et al.; "Effects on Pulp Properties of Magnesium Hydroxide in Peroxide Bleaching"; BioResources; vol. 8, No. 2; p. 2337-2350; 2013.

Khristova, P., et al; "Multistage Peroxide Bleaching of French Hemp"; Industrial Crops and Products; vol. 18; p. 101-110; 2003.

"Papermaking Translation Series vol. 12" (Compilation Room of Paper Industry Administration of the Ministry of Light Industry, p. 58, Light Industry Press, Feb. 1960). Chinese reference.

Papermaking Translation Series vol. 12 (Compilation Room of Paper Industry Administration of the Ministry of Light Industry, p. 58, Light Industry Press, Feb. 1960). English Translation.

"How is pulp made" | UPM Pulp, https://www.upmpulp.com/sustainable-pulp/how-is-pulp-made/, Oct. 3, 2018, 6 pgs.

Batra, S.K.; "Introduction to Nonwovens Technology"; DEStech Publications, Inc. (2012) p. 131-160.

Chemical Week Publication; "New Chemical Perspectives"; Soap and Cosmetics; Mar. 2000; p. 4, p. 12-13.

Floyd, D.E.; "Polyamide Resins"; Reinhold Publishing Corporation, 1996; p. 1-227.

Hamiltyon et al., "Secondary Fibers and Non-wood Pulping", 1987, The Joint Textbook Committee of the Paper Industry, p. 11.

Lee et al., "Antimicrobial and Blood Repellent Finishes for Cotton and Nonwoven Fabrics Based on Chitosan and Fluropolymers", Textile Research Journal, Feb. 1999; pp. 104-112; vol. 69 (2).

Paper Pulp Technical Manual (English translation), Japan Technical Association of the Pulp and Paper Industry, Jan. 30, 1992, 5th edition, 2 pages.

* cited by examiner

BLEACHING AND SHIVE REDUCTION PROCESS FOR NON-WOOD FIBERS

CROSS REFERNECE TO RELATED APPLICATION

This application claims benefit of U.S. Provisional Patent Application Ser. No. 61/000,837, filed May 20, 2014, which is incorporated herein in its entirety by reference.

TECHNICAL FIELD

The instant invention generally is related to methods for fiber production. More specifically, the instant invention is related to methods for non-wood fiber bleaching and shive reduction.

BACKGROUND OF THE INVENTION

Plant fibers fall into three groups: seed fibers (e.g., cotton and kapok), stem fibers (bast fibers, e.g., flax and hemp), and leaf fibers (e.g., sisal and kenaf). Bast fibers occur as bundles of fibers, which extend through the length of the plant stems, located between the outer epidermal "skin" layers and the inner woody core (cortex) of the plant. Therefore, bast fiber straw includes three primary concentric layers: a bark-like skin covering layer, a bast fiber layer, and an inner, woody core. The woody core has various names, which depends on the particular plant type. For example, the flax woody core is referred to as "shive." Thus, "shive" refers to all woody-core materials contained in bast fiber plants.

The bundles of fibers are embedded in a matrix of pectins, hemi-celluloses, and some lignin. The lignin must be degraded, for example by "retting" (partial rotting) of the straw, for example by enzymes produced by fungi (e.g., during dew-retting), or bacteria (e.g., during water-retting). Decortication involves mechanically bending and breaking the straw to separate the fiber bundles from the shive and skin layers, and then removing the non-fiber materials using a series of conventional mechanical cleaning stages.

A substantial proportion of the pectin-containing material that surrounds the individual bast fibers is pectin, with the remaining portion being primarily various water-soluble constituents. Pectin is a carbohydrate polymer, which includes partially-methylated poly-galacturonic acid with free carboxylic acid groups present as calcium salts. Pectin is generally insoluble in water or acid, but may be broken down, or hydrolyzed, in an alkaline solution, such as an aqueous solution of sodium hydroxide.

Removal of the pectin-containing material, or gum, is necessary in many instances to utilize the fiber for its intended purposes. Various methods for pectin removal include degumming, or removing, the pectin-containing substances from the individual bast fiber. For example, U.S. Pat. No. 2,407,227 discloses a retting process for the treatment of fibrous vegetable or plant material, such as flax, ramie, and hemp. The retting process employs micro-organisms and moisture to dissolve or rot away much of the cellular tissues and pectins surrounding fiber bundles, facilitating separation of the fiber bundles from the shive and other non-fiber portions of the stem. Thus, the waxy, resinous, or gummy binding substances present in the plant structure are removed or broken down by means of fermentation.

Following retting, the stalks are broken, and then a series of chemical and mechanical steps are performed to produce individual or small bundles of cellulose fiber. However, a common problem still occurring in non-wood fiber processes is the occurrence of shives, which are dark, undesirable particles in finished paper products. Shives includes pieces of stems, "straw," dermal tissue, epidermal tissue, and the like.

Shives are substantially resistant to defiberizing processes, rendering their presence problematic. Even following oxidative bleaching, shives continue to have deleterious effects on the appearance, surface smoothness, ink receptivity, and brightness of a finished paper product. Mechanical removal of shive to the level required for a high value product involves the application of significant mechanical energy, which results in fiber breakage and generation of fines. The fines are a yield loss, increasing the production cost. Further, the broken fibers reduce the overall fiber strength so they either cannot be used in some manufacturing processes and/or result in weak textile or paper products.

Thus, conventional methods of non-wood fiber processing are not sufficiently robust to remove, decolorize, and break up the residual shive present in the fibers. Thus, processed and finished fibers can still include dark particles of shive, which are both aesthetically unattractive and reduce the commercial value of the fiber product. Furthermore, conventional alkalizing scouring and peroxide bleaching processes are too mild to significantly degrade the lignin in shive.

Accordingly, there exists an on-going need for a method to selectively degrade the shives present in the non-wood fibers. Thus, the present invention is directed to meeting this and other needs and solving the problems described above.

SUMMARY OF THE INVENTION

The present invention is directed to methods of increasing the brightness and reducing the residual visible content of shive in non-wood fibers and nonwovens and tissues including those fibers. In one aspect, a method of increasing the brightness of non-wood fibers comprises forming a mixture of non-wood fibers and exposing the mixture to a brightening agent. The brightening agent is a permanganate compound, an acid, or a combination of the permanganate compound and the acid. The resulting brightened fibers have a brightness greater than the fibers of the mixture before exposure as measured by MacBeth UV-C standard.

In another aspect, a method of reducing the amount of residual shive in non-wood fibers comprises forming a mixture of non-wood fibers and exposing the mixture to a brightening agent to produce low-shive fibers. The brightening agent is a permanganate compound, an acid, or a combination of the permanganate compound and the acid, and the resulting low-shive fibers have less visible shive content that the fibers of the mixture before exposure.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the invention will become apparent from the following description taken in conjunction with the examples showing aspects of the present invention.

BRIEF DESCRIPTION OF THE DRAWINGS

The invention will be better understood and the above object as well as other objects other than those set forth above will become apparent when consideration is given to the following detailed description thereof. Such description makes reference to the annexed drawing wherein.

DETAILED DESCRIPTION OF THE INVENTION

Figure 1:
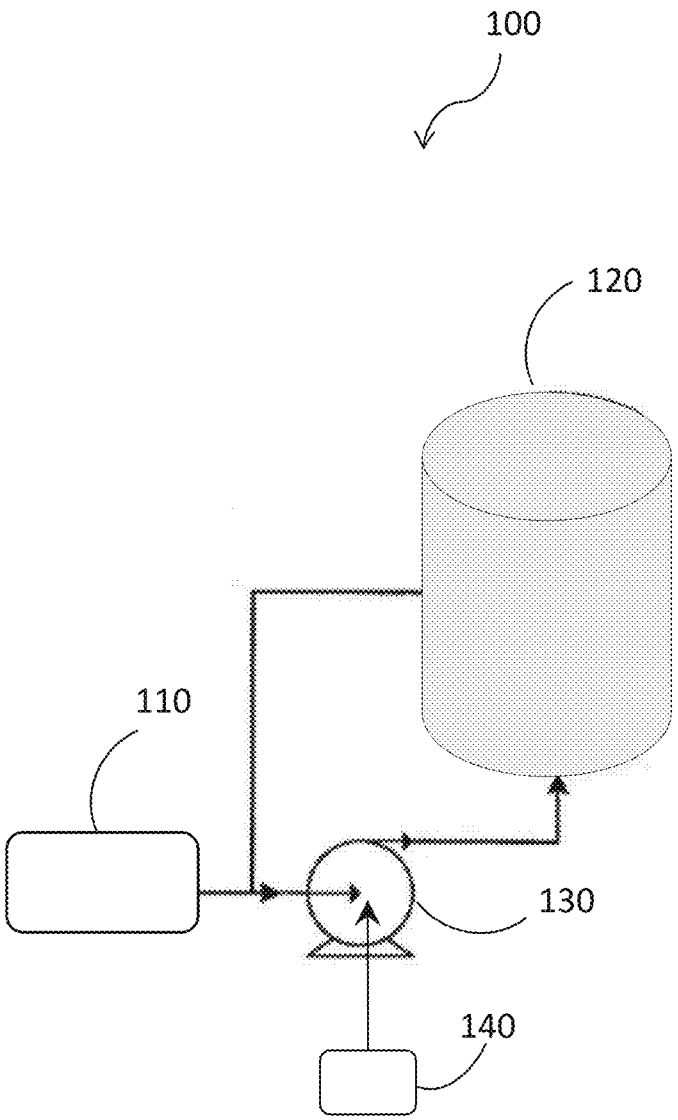
FIG. 1 is an illustration of a method for introducing the brightening agent using a circulation pump.

For a fuller understanding of the nature and desired objects of this invention, reference should be made to the above and following detailed description taken in connection with the accompanying figures. When reference is made to the figures, like reference numerals designate corresponding parts throughout the several figures.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

As used herein, the articles "a" and "an" preceding an element or component are intended to be nonrestrictive regarding the number of instances (i.e. occurrences) of the element or component. Therefore, "a" or "an" should be read to include one or at least one, and the singular word form of the element or component also includes the plural unless the number is obviously meant to be singular.

As used herein, the terms "invention" or "present invention" are non-limiting terms and not intended to refer to any single aspect of the particular invention but encompass all possible aspects as described in the specification and the claims.

As used herein, the term "about" modifying the quantity of an ingredient, component, or reactant of the invention employed refers to variation in the numerical quantity that can occur, for example, through typical measuring and liquid handling procedures used for making concentrates or solutions in the real world. Furthermore, variation can occur from inadvertent error in measuring procedures, differences in the manufacture, source, or purity of the ingredients employed to make the compositions or carry out the methods, and the like. Whether or not modified by the term "about," the claims include equivalents to the quantities. In one aspect, the term "about" means within 10% of the reported numerical value, or within 5% of the reported numerical value.

As used herein, the term "shive(s)" means dark particles in processed fibers. Nonlimiting examples of shive include pieces of stems, "straw," dermal tissue, epidermal tissue, and the like.

As used herein, the terms "percent by weight," "% by weight," and "wt. %" mean the weight of a pure substance divided by the total dry weight of a compound or composition, multiplied by 100. Typically, "weight" is measured in grams (g). For example, a composition with a total weight of 100 grams, which includes 25 grams of substance A, will include substance A in 25% by weight.

As used herein, the terms "nonwoven" means a web or fabric having a structure of individual fibers which are randomly interlaid, but not in an identifiable manner as is the case of a knitted or woven fabric. The brightened fibers in accordance with the present invention can be employed to prepare nonwoven structures and textiles.

As used herein, the term "non-wood fibers" means fibers produced by and extracted from a plant or animal, the exception that such fibers do not include wood fibers, i.e., derived from a tree, and man-made fibers formed from cellulose, e.g. viscose. Non-limiting examples of suitable non-wood fibers are plant-based, non-wood fibers, such as bast fibers. Bast fibers include, but are not limited to, flax fibers, hemp fibers, jute fibers, ramie fibers, nettle fibers, Spanish broom fibers, kenaf plant fibers, or any combination thereof. Non-wood fibers include seed hair fibers, for example, cotton fibers. Non-wood fibers can also include animal fibers, for example, wool, goat hair, human hair, and the like.

As used herein, the term "kier" means a circular boiler or vat used in processing, bleaching and/or scouring non-wood fibers.

As used herein, the term "brightening agent" refers to a permanganate compound, an acid, or a combination of the permanganate compound and the acid. In addition to these agents, other compounds and agents can be included in the brightening agent.

As used herein, the term "brightness" refers to the whiteness of a composition of fibers. As discussed herein, brightness is determined by the "MacBeth UV-C" test method, utilizing a Macbeth 3100 spectrophotometer, commercially available from X-Rite, Inc., Grand Rapids, Mich. UV-C is the illuminant (lamp) used for brightness testing. As used herein, the term "gain" means the increase in fiber brightness following a bleaching process. Brightness and gain measurements of the fibers, before and after exposure to the brightening agent, are conducted on thick pads of the fiber. The fiber pads are prepared by diluting the fibers to a consistency in a range between about 2% and about 10% with water, mixing to separate the fibers, and then dewatering the fibers, for example on a Buchner funnel with a filter paper, to form the fiber pad. The fiber pad can be further dewatered by pressing between blotters in a laboratory press and then dried on a speed dryer to form a dry cake. The fiber pads can then be air-dried for several days prior to brightness testing. Brightness measurements also can be done on the fiber by: 1) drying the fiber with hot air to less than 2-4% moisture, 2) carding the fiber to straighten out and align the fibers into a mat, lap or sliver, and 3) measuring the brightness of the lap, mat or sliver. Brightness and gain testing of the fibers according to the MacBeth UV-C brightness standard is conducted before and after exposure to the brightening agent, with the brightened fibers having a brightness greater than the fibers before exposure. The MacBeth test measures both TAPPI brightness and LAB whiteness. L* is the whiteness, and a* and b* are the color (red-green and blue-yellow). A* and b* values close to 0 indicate very low color/no color. The UV-C test measures the illuminate, including the both the ultraviolet and color components of the light.

As used herein, the term "consistency" means to the percent (%) solid in a composition comprising a solid in a liquid carrier. For example, the consistency of a fiber slurry/fiber mat/fiber mass/fiber donut weighing 100 grams and comprising 50 grams of fibers has a consistency of 50%.

As used herein, the terms "cellulose fibers," "cellulosic fibers," and the like refer to any fibers comprising cellulose. Cellulose fibers include secondary or recycled fibers, regenerated fibers, or any combination thereof.

Conventional plant-based, non-wood fiber production involves mechanical removal of non-fiber shive material, followed by chemical removal of pectin and a mild oxidative bleaching step. Plants, including flax, require an initial "retting" step before mechanical removal of non-fiber material. The retting process employs micro-organisms and moisture to dissolve or rot away much of the cellular tissues and pectins surrounding fiber bundles, thus facilitating separation of the fiber from the stem. Thus, waxy, resinous, or gummy binding substances present in the plant structure are removed or broken down by means of fermentation. Pectin removal can be accomplished using an alkaline agent, such as sodium hydroxide, at elevated temperatures. Enzymes and other chemicals, such as detergents and wetting agents, also can be added to enhance pectin detachment from the fibers. U.S. Pat. Nos. 8,603,802 and 8,591,701 and Canadian Patent No. CA2,745,606, which are incorporated herein in their entirety by reference, disclose methods for pectin removal using enzymes. Following the pectin extraction step, the fibers are washed and treated with a mixture of hydrogen peroxide and sodium hydroxide to increase the brightness and whiteness of the finished fiber.

However, there are drawbacks to these conventional methods. First, available pectin extraction and bleaching steps are not robust enough to decolorize and/or break up residual shive in the fiber. Second, the bleaching process also is not robust enough to increase the brightness to levels required for high quality commercial products. The result is finished fibers containing dark shive particles, which is aesthetically unappealing and reduces the commercial value of the fiber product. The shive also interferes with the manufacturing processes which utilize the fiber. For example, particles of shive can plug the filters on a hydro entanglement system. The shive also has very low bonding ability. Thus, any shive entrained in the finished product will fall out and be unappealing to the end user. Further, residual shive could also be a potential source of contamination when used, for example, in food service wipes.

One commercially available solution to the shive problem is to either increase the intensity of the mechanical shive removal process or to add multiple mechanical removal stages so that the residual shive content is low enough to be imperceptible in the finished product. However, this solution has drawbacks. First, additional mechanical processing increases the operating and capital costs of production. Second, the additional mechanical processing damages the fragile fibers, resulting in a product with inferior tensile strength properties. Finally, additional mechanical processing reduces the yield of the finished fiber because of the generation of fines and long fiber losses due to the inherent inefficiency of mechanical processing.

However, in accordance with the present invention, the addition of a permanganate compound, an acid, or a combination of the permanganate compound and the acid both increases the fiber brightness and reduces the residual shive to levels that dramatically reduce the impact of shive on the appearance of the finished fiber. Furthermore, and without being bound by theory, it is believed that the brightening process disclosed herein reduces the integrity of the shives so that they are more easily broken up and removed in mechanical treatment. Reduced shive content after exposure to the brightening agent can be assessed by visual examination of the fibers.

Furthermore, the disclosed process provides a significantly higher brightness compared to conventional process, which results in production of fibers with higher commercial value. Thus, the process can be used to produce a commercially useful fiber from low quality raw materials that cannot be suitably processed with conventional processes. Finally, the process is suitable for a variety of lower value plant fiber raw materials that cannot be transformed into a commercially useful fiber without using other processes. The disclosed method provides a method to specifically reduce shive content, without compromising fiber strength.

Accordingly, the present disclosure is directed to a method of increasing the brightness of natural fibers, in particular, non-wood fibers. In one aspect of the present invention, the method comprises forming a mixture of non-wood fibers and exposing the mixture to a brightening agent to produce brightened fibers having a brightness greater than the fibers of the mixture before exposure as measured by MacBeth UV-C standard. The brightening agent can be permanganate compound, an acid, or a combination of the permanganate compound and the acid. In another aspect, the method disclosed reduces the amount of residual shive in non-wood fibers to provide low-shive fibers having less visible shive content than the fibers of the mixture before exposure.

One type of plant-based, non-wood fibers is bast fibers. Bast fibers are found in the stalks of the flax, hemp, jute, ramie, nettle, Spanish broom, and kenaf plants, to name only a few. Typically, native state bast fibers are 1 to 4 meters in length. These long native state fibers are comprised of bundles of straight individual fibers that have lengths between 20-100 millimeters (mm). The bundled individual fibers are glued together by pectins (a class of plant resins).

Bast fibers bundles can be used for both woven textiles and cordage. An example of a woven textile produced with flax bast fiber bundles is linen. More recently, as provided in U.S. Pat. No. 7,481,843, partially separated bast fiber is produced to form yarns and threads for woven textiles. However, yarns and threads are not suited for nonwoven fabrics.

In accordance with the present invention, any plant-based, non-wood fibers can be used. In one example, suitable fibers include cotton fibers, bast fibers, or any combination thereof. Bast fibers can be derived from a variety of raw materials. Non-limiting examples of suitable bast fibers include, but are not limited to, flax fibers, hemp fibers, jute fibers, ramie fibers, nettle fibers, Spanish broom fibers, kenaf plant fibers, or any combination thereof. Secondary or recycled fibers from waste paper can be used. Non-wood fibers can also include animal fibers, for example, wool, goat hair, human hair, and the like.

Initially, pectin can be substantially removed from the non-wood fibers to form substantially individualized fibers. Thus, the fibers are rendered substantially straight and are substantially pectin-free. The fibers can be individualized, by pectin removal, using mechanical or chemical means.

Enzymatic treatment is a non-limiting example of a chemical treatment that can be used to substantially remove pectin. PCT International Publication No. WO 2007/140578 describes a pectin removal technology which produces individualized hemp and flax fiber for application in the woven textile industry. The process to remove pectin described in WO 2007/140578 can be employed.

The non-wood fibers can have a mean length in a range between about 1 and 100 mm depending on the characteristics of the particular fibers and the cut length of the plant stalks prior to chemical processing. In one aspect, the individualized non-wood fibers have a mean length of at least 10 mm, at least 20 mm, at least 30 mm, and at least 40 mm. In another aspect, the individualized non-wood fibers have a mean length greater than 50 mm. Still yet, in another aspect, the non-wood, plant based fibers have a mean length about or in a range between about 5, 10, 15, 20, 25, 30, 35, 40, 45, 50, 55, 60, 65, 70, 75, 80, 85, 90, and 95 mm.

In addition to non-wood fibers, the fiber mixture can include fibers derived from one or more source, including, but not limited to, cellulosic fibers, including staple fibers and regenerated cellulose, and thermoplastic fibers. Optionally, the cellulosic fibers are secondary, recycled fibers. Non-limiting examples of cellulosic fibers include, but are not limited to, hardwood fibers, such as hardwood kraft fibers or hardwood sulfite fibers; softwood fibers, such as softwood kraft fibers or softwood sulfite fibers; or any combination thereof. Non-limiting examples of regenerated cellulose include rayon, lyocell, (e.g., TENCEL®), Viscose®, or any combination thereof. TENCEL® and Viscose® are commercially available from Lenzing Aktiengesellschaft, Lenzing, Austria.

In one aspect, the mixture of non-wood fibers includes synthetic, polymeric, thermoplastic fibers, or any combination thereof. Thermoplastic fibers include the conventional polymeric fibers utilized in the nonwoven industry. Such fibers are formed from polymers which include, but are not limited to, a polyester such as polyethylene terephthalate; a nylon; a polyamide; a polypropylene; a polyolefin such as polypropylene or polyethylene; a blend of two or more of a polyester, a nylon, a polyamide, or a polyolefin; a bi-component composite of any two of a polyester, a nylon, a polyamide, or a polyolefin; and the like. An example of a bi-component composite fiber includes, but is not limited to, a fiber having a core of one polymer and a sheath comprising a polymer different from the core polymer which completely, substantially, or partially encloses the core.

Brightness measurements of the fibers, before and after exposure to the brightening agent, can be conducted on thick pads of the fiber. The fiber pads can be prepared by diluting the fibers to a consistency in a range between about 2 and about 10% with water, mixing to separate the fibers, and then de-watering the fibers, for example on a Buchner funnel with a filter paper, to form the fiber pad. The fiber pad can be further dewatered by pressing between blotters in a laboratory press and then dried on a speed dryer to form a dry cake. The fiber pads can then be air-dried for several days prior to brightness testing.

Brightness measurements of the fibers, before and after exposure to the brightening agent, can be conducted on thick pads of the fiber. Brightness testing of the fibers according to the MacBeth UV-C brightness standard is conducted before and after exposure to the brightening agent, with the brightened fibers having a brightness greater than the fibers before exposure. The brightened fibers of the present invention can have a brightness in a range between about 65 and about 90 as measured by MacBeth UV-C standard. In one aspect, the brightened fibers have a brightness in a range between about 77 and about 90. In another aspect, the brightened fibers have a brightness in a range between about 80 and about 95. Yet, in another aspect, the brightened fibers have a brightness in a range between about 65 and about 85.

The brightness gain, or increase in fiber brightness following exposure to the brightening agent is in a range between about 10 and about 60 as measured by MacBeth UV-C standard. In one aspect, the brightness gain is in a range between about 15 and about 30 as measured by MacBeth UV-C standard. In another aspect, the brightness gain is in a range between about 45 and about 55 as measured by MacBeth UV-C standard. Yet, in another aspect, the brightness gain is about or in any range between about 10, 15, 20, 25, 30, 35, 40, 45, 50, 55, and 60 as measured by MacBeth UV-C standard.

The brightened fibers of the present invention can be used for any nonwoven fabric products or textiles, including air-laid, carded, spunbonded, and hydroentangled substrates. In one aspect, a nonwoven fabric comprises non-wood fibers having a brightness greater than about 65 as measured by MacBeth UV-C standard.

Nonwood fiber brightening can be accomplished by 1) retting, mechanical separation of bast fibers, scouring to remove pectin+waxes+lignin, and one or two stage brightening as disclosed herein; 2) retting, mechanical separation of bast fibers, scouring to remove pectin+waxes+lignin, conventional peroxide or other bleaching/pre-bleaching, and one or two stage bleaching with the disclosed process; or 3) retting, mechanical separation of bast fibers, one or two stage bleaching with the disclosed process, and optionally, scouring or other bleaching/pre-bleaching.

Then, the non-wood fibers (pre-bleached or unbleached) are combined to form a mixture. Pectin removal by chemical methods can be performed before or after forming the mixture. The mixture can be formed into a fibrous mat, a fiber mat, a fiber pad, a thick fiber pad, a wet cake, or a "donut" when used in a kier based system. Optionally, the mixture can then be wetted before exposing the mixture to the brightening agent. The mixture can be diluted to any desired consistency, wetted, and/or combined with any desired additives, non-limiting examples of which are mentioned below.

In the mixture before exposure to the brightening agent, the fibers have a consistency in a range between about 1% and about 50%. In one aspect, the fibers in the mixture have a consistency in a range between about 10% and about 30%. In another aspect, the fibers in the mixture have a consistency in a range between about 15% and about 35%. Yet in another aspect, the fibers in the mixture have a consistency in a range between about 20% and about 40%. Still yet, in another aspect, the fibers in the mixture have a consistency about or in any range between about 1, 2, 5, 7, 10, 12, 15, 17, 20, 22, 25, 27, 30, 32, 35, 37, 40, 42, 45, 47 and 50%.

To increase the brightness of the fibers, the fiber mixture is exposed to a brightening agent, the brightening agent being a permanganate compound, an acid, or both the permanganate compound and the acid. The fiber mixture can be exposed to the brightening agent by any suitable method.

In one aspect, treating scoured flax fiber with the permanganate compound under acidic conditions generates a substantial improvement in the brightness of the fibers, as well as reduces dark color and the structural integrity of shive contaminants. Optionally, the process includes a second stage of brightening or bleaching, which can include reducing agents, phosphate compounds, or both.

The permanganate compound can be combined with the acid and adjusted to a pH in a range between about 1 and about 6. Then the combination can be added to the mixture of non-wood fibers. Optionally the temperature and time can be adjusted to provide optimal brightening and visible shive reduction.

The permanganate compound can be any permanganate containing salt or compound. A wide variety of permanganate compounds can be employed, such as alkali metal and alkaline-earth metal permanganates. Non-limiting examples of suitable permanganate compounds include potassium permanganate, sodium permanganate, or any combination thereof. Optionally, the permanganate is compounded with other materials. For example, the permanganate compound can be compounded with calcium sulfate, diatomaceous earth, or any combination thereof.

The permanganate compound can be added to the fibers in an amount in a range between about 0.1 and about 10 wt. % based on the dry weight of the fibers. In one aspect, the permanganate compound is added in an amount in a range between about 1 and about 5 wt. % based on the dry weight of the fibers. In another aspect, the permanganate compound is added in an amount in a range between about 2 and about 8 wt. % based on the dry weight of the fibers. Yet, in another aspect, the permanganate compound is added in an amount about or in any range between about 0.1, 0.3, 0.5, 0.7, 1.0, 1.2, 1.5, 1.7, 2.0, 2.2, 2.5, 2.7, 3.0, 3.2, 3.5, 3.7, 4.0, 4.2, 4.5, 4.7, 5.0, 5.2, 5.5, 6.0, 6.5, 7.0, 7.5, 8.0, 8.5, 9.0, 9.5, and 10.0.

The acid can be combined with the permanganate compound in the brightening agent. Non-limiting examples of suitable acids include acetic acid, carbonic acid, chloric acid, citric acid, formic acid, hydrobromic acid, hydrocyanic acid, hydroiodic acid, nitric acid, nitrous acid, oxalic acid, peracetic acid, phosphoric acid, phosphorous acid, sulfuric acid, or any combination thereof. Although higher doses of potassium permanganate can lead to dark precipitation on the fibers (compare FIGS. 1A and 1B with 2A and 2B), use of oxalic acid prevent formation of dark precipitates.

The pH of the brightening agent is adjusted to about 1 to about 6. In one aspect, the brightening agent pH is in a range between about 2 and about 5. In another aspect, the brightening agent pH is in a range between about 1 and about 4. Yet in another aspect, the brightening agent is about or in any range between about 1.0, 1.5, 2.0, 2.5, 3.0, 3.5, 4.0, 4.5, 5.0, 5.5, and 6.0.

The mixture of non-wood fibers can be exposed to the brightening agent for a time in a range between about 1 and about 30 minutes. In one aspect, the fiber mixture is exposed to the brightening agent for a time in a range between about 5 and about 15 minutes. In another aspect, the fiber mixture is exposed to the brightening agent for a time in a range between about 10 and about 25 minutes. Yet, in another aspect, the fiber mixture is exposed to the brightening agent for a time about or in any range between about 1, 5, 10, 15, 20, 25, 30, 35, 40, 45, 50, 55, 60, 65, 70, 75, 80, 85, 90, 95, 100, 105, 110, 115, and 120 minutes.

During brightening and shive reduction process, the fiber mixture can be maintained at a temperature in a range between about 20 and about 80° C. In one aspect, the temperature is in a range between about 30 and about 60° C. In another aspect, the temperature is in a range between about 40 and about 70° C. Yet, in another aspect, the temperature is in a range between about 50 and about 80° C. Still yet, in another aspect, the temperature is about or in any range between about 20, 25, 30, 35, 40, 45, 50, 55, 60, 65, 70, 75, and 80° C.

The brightening agent can include other additional bleaching components, for example a peroxide compound and an alkaline compound. Non-limiting examples of suitable peroxide compounds include sodium peroxide, hydrogen peroxide, or both hydrogen peroxide and sodium peroxide. Suitable alkaline compounds include, but are not limited to, sodium hydroxide, potassium hydroxide, calcium hydroxide, monoethanolamine, ammonia, or any combination thereof. After exposing the fibers to the brightening agent, the fibers can be mixed or agitated. However, excessive mixing can induce fiber tangling.

Turning now to the figures, FIG. 1 illustrates an exemplary method 100 of exposing the fiber mixture to the brightening agent, which includes a permanganate compound, an acid, or both the permanganate compound and the acid. The brightening agent can be added to a solution, for example from a tank 110, or bleaching liquor 140 via a recirculation loop. The non-wood fibers can be disposed within a fiber processing Kier 120. The bleaching liquor 140, which can include any additional components can be introduced and circulated through the system and the fibers with a liquor circulation pump 130.

Figure 2:
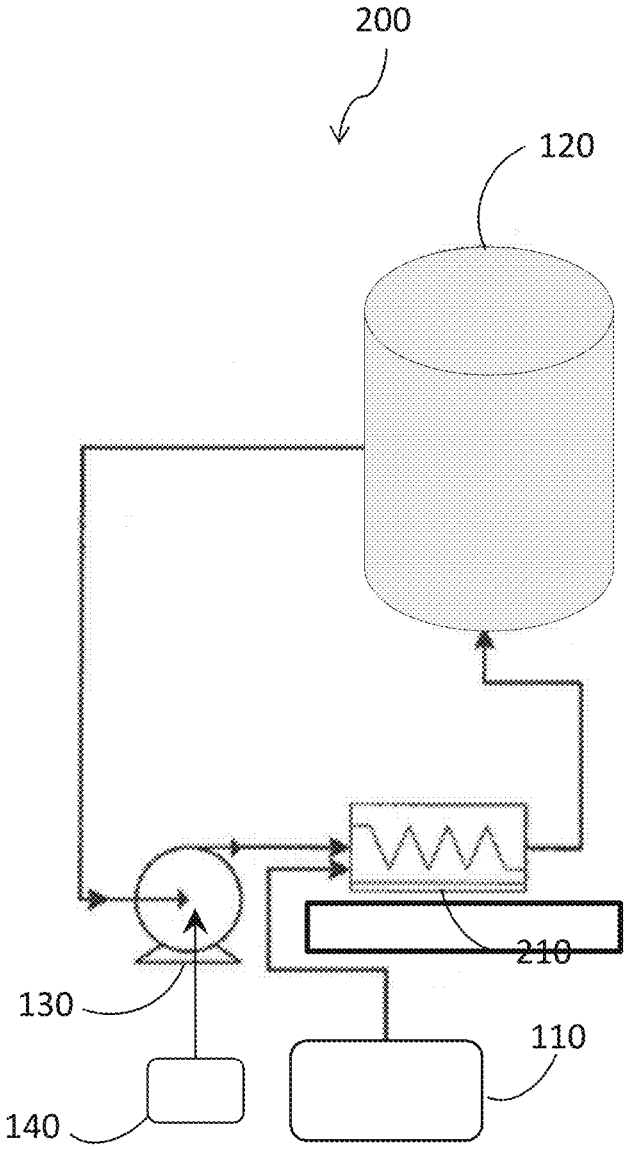
FIG. 2 is an illustration of a method for brightening fibers using a mixer after the circulation pump.

FIG. 2 illustrates an exemplary method 200 of exposing the fiber mixture to the brightening agent. As shown, a static or active mixing system 210 after the liquor circulation pump 130 can be used to continuously mix the brightening agent in the bleaching liquor 140. Alternatively, the brightening agent can be added directing into the static or active mixing system 210 from a tank 110.

Figure 3:
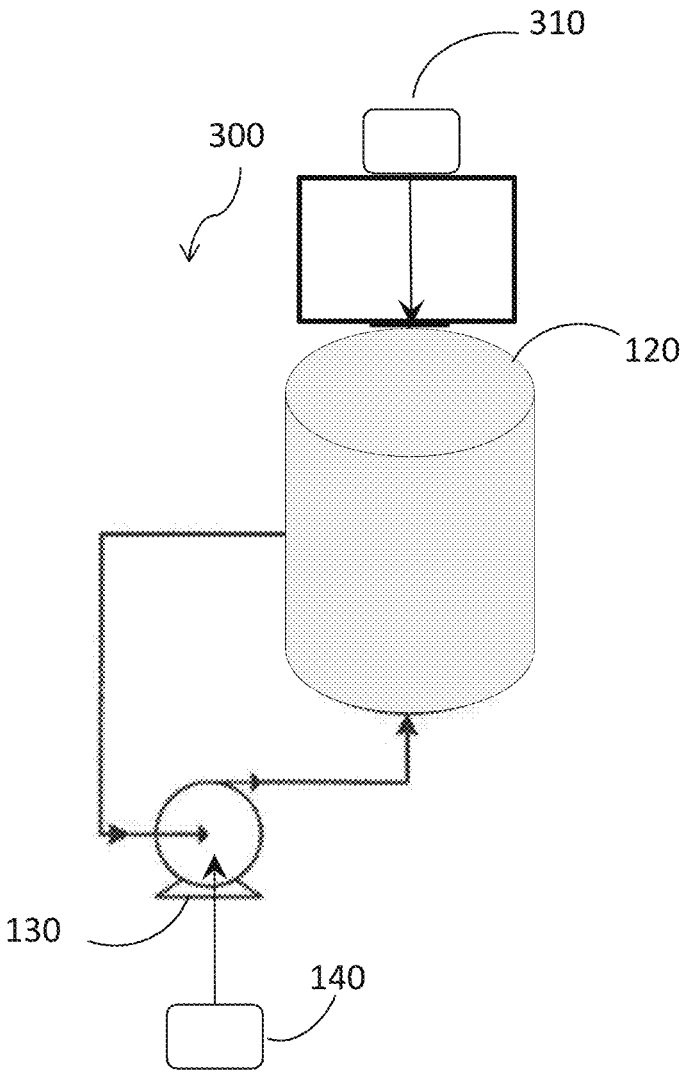
FIG. 3 is an illustration of a method for introducing the brightening agent directly into the non-wood fibers.

FIG. 3 illustrates an exemplary method 300 of exposing the fiber mixture to the brightening agent. As shown, the brightening agent 310 is directly introduced into top of the fiber processing Kier 120.

Figure 4:
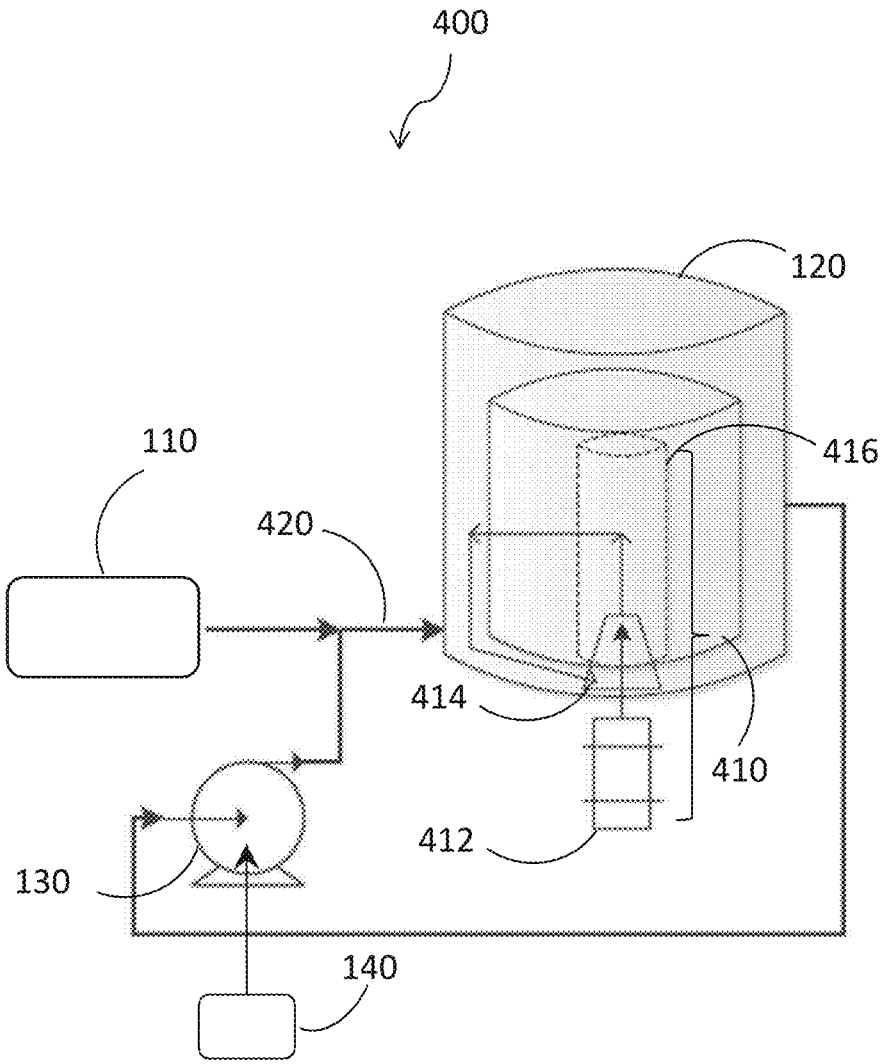
FIG. 4 is an illustration of a method for brightening the non-wood fibers using an internal and external liquor circulation system.

FIG. 4 illustrates an exemplary method 400 of exposing the fiber mixture to the brightening agent. Method 400 has an additional internal circulation system 410 in addition to the external liquor circulation systems of methods 100, 200, and 300 using the liquor circulation pump 130. The solution or bleaching liquor 140 including the brightening agent feeds into the intake of the internal pump 412. Alternatively, the brightening agent is added from a tank 110 after the liquor circulation pump 130. The impeller 414 continuously mixes the brightening agent in the bleaching liquor 140. The bleaching liquor 140 with the brightening agent then enters the center shaft 416 of the basket and then travels and circulates through the fiber mass within the fiber processing Kier 120.

Figure 5:
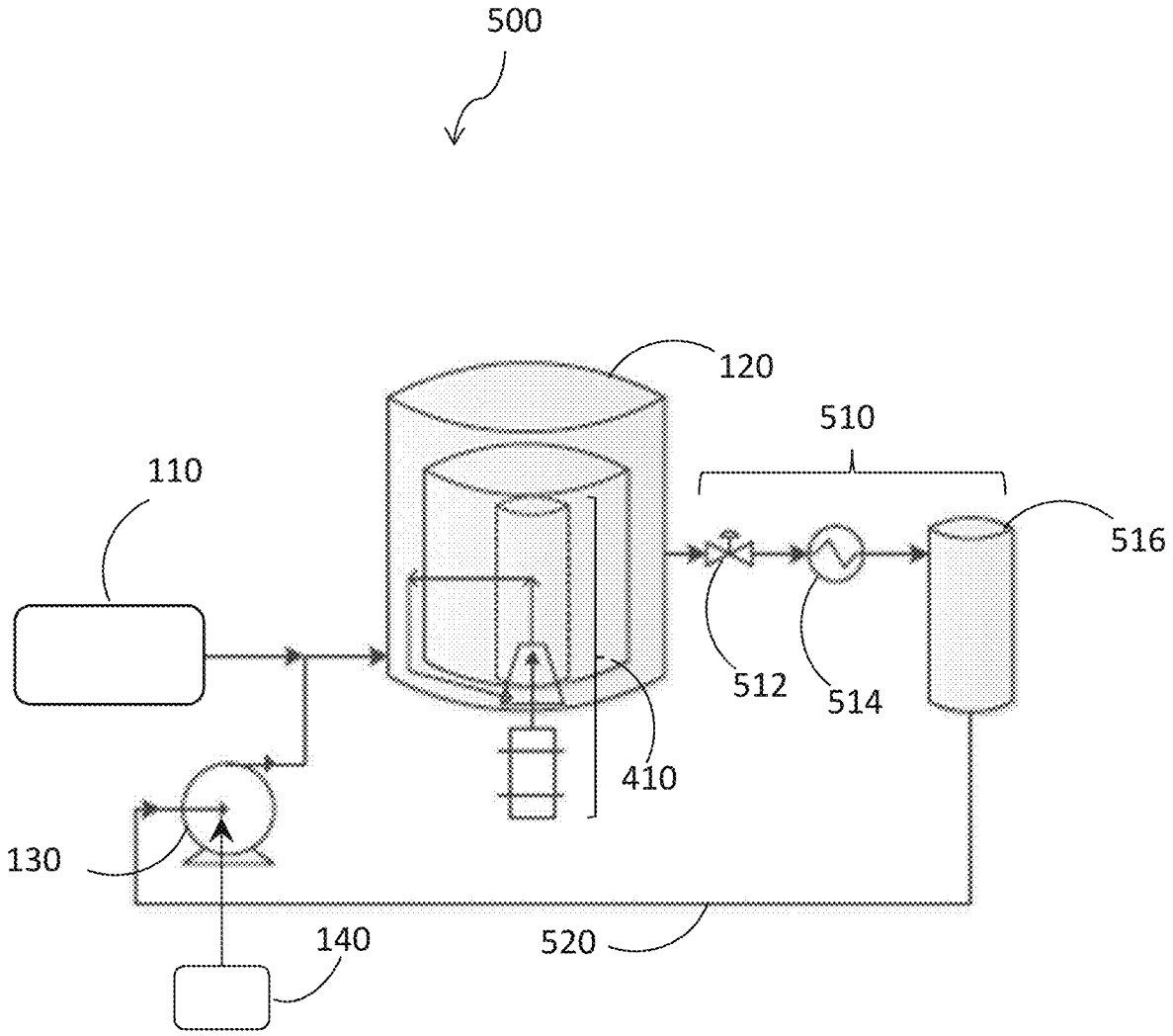
FIG. 5 is an illustration of a method for cooling the liquor in the system of FIG. 4.

FIG. 5 is an illustration of a method 500 for cooling the liquor in the system of FIG. 4. In method 500, employing a cooling system 510, the bleaching liquor 140 with the brightening agent from inside the fiber processing Kier 120 is cooled below the flash temperature, for example, less than about 100° C., in a noncontact heat exchanger 514 and then into a small liquor tank 516. A control valve 512 controls recirculation of the bleaching liquor 140 into the cooling system 510. The cooled liquor 520 is then is pumped back into the liquor circulation pump 130 of the external circulation system. The cooling system 510 allows for addition of chemicals, including additional amounts of the brightening agent, without depressurizing and emptying the fiber processing kier 120.

Figure 6A:
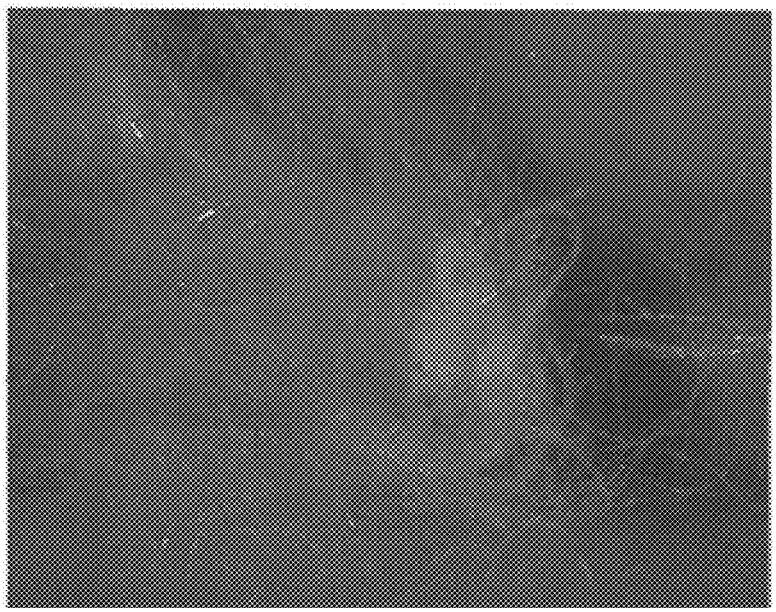
FIGS. 6A and 6B are photomicrographs of white areas within brightened flax fibers at different magnifications.
Figure 6B:
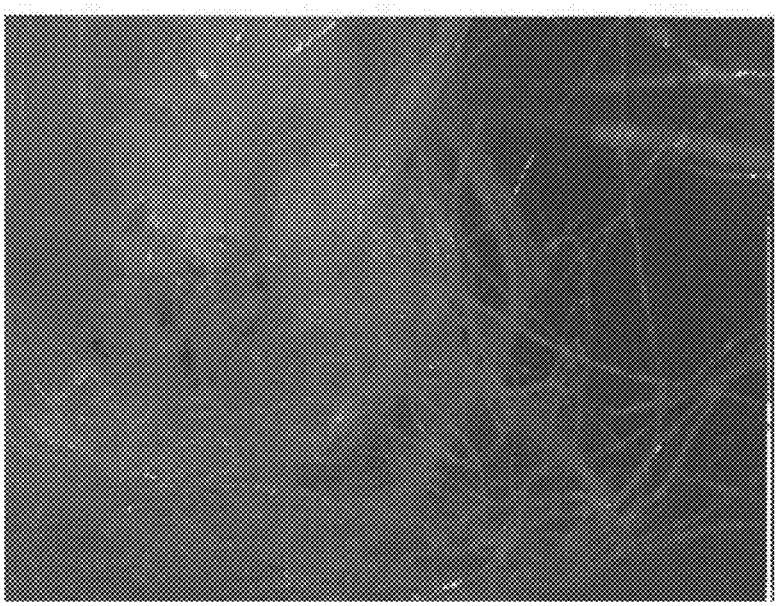
Figure 7A:
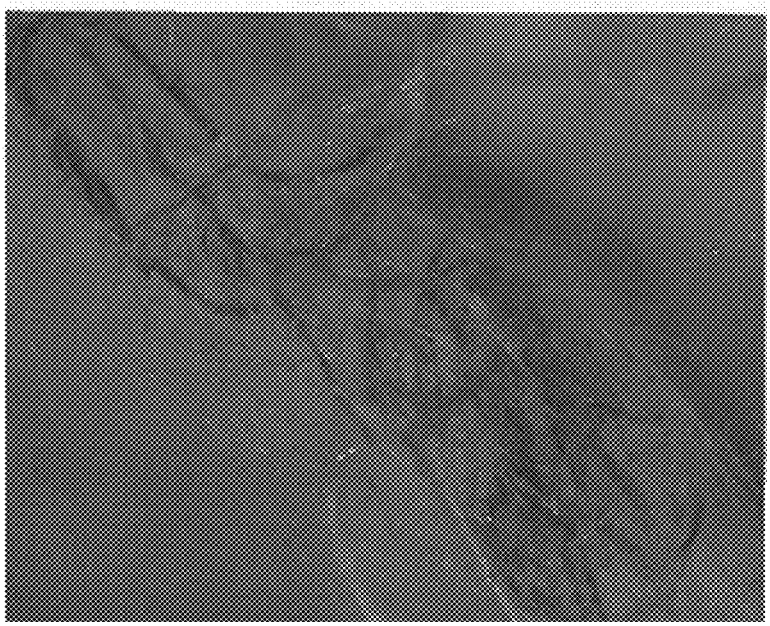
FIGS. 7A and 7B are photomicrographs of brown areas within brightened flax fibers at different magnifications.
Figure 7B:
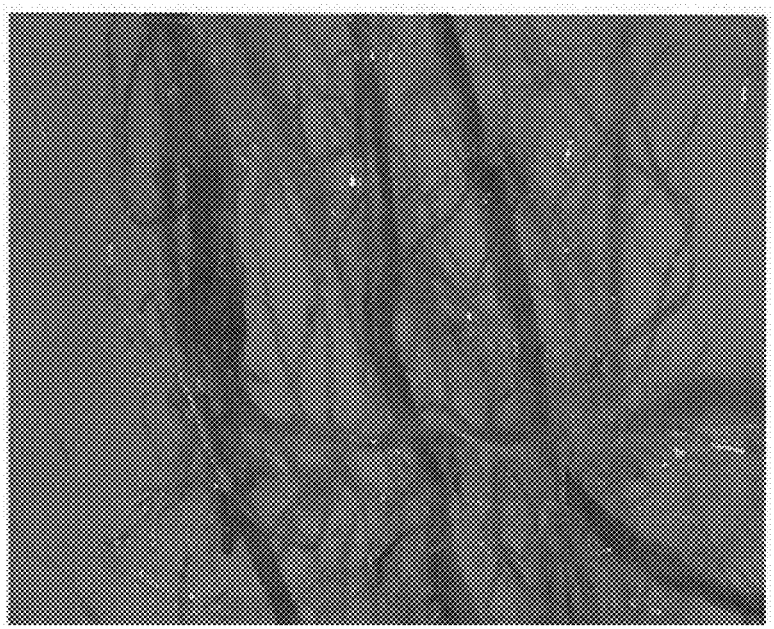
Figure 8A:
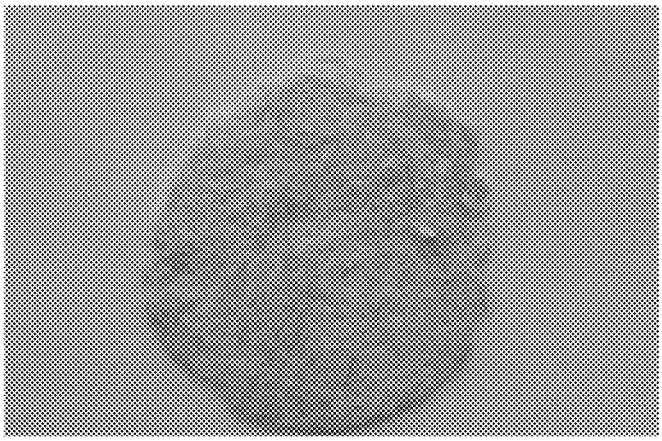
FIGS. 8A and 8B are low and high magnification photomicrographs, respectively, of the effect of sodium bisulfite on dark precipitation in the fibers.
Figure 8B:
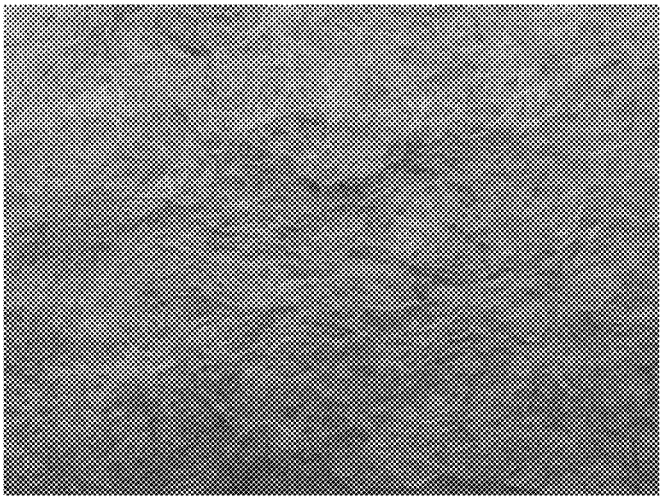

Although the brightening agent bleaches a substantial majority of the fibers (see FIGS. 6A and 6B), some areas of dark precipitation can occur with higher permanganate doses (see FIGS. 7A and 7B). However, the addition of a reducing agent or a phosphate compound/salt at the end of the exposure time significantly reduces the black precipitate and results in an increased brightness (see FIGS. 8A and 8B). Thus, the fibers can be exposed to at least a second brightening agent, for example a reducing agent, a phosphate salt, or both a reducing agent and a phosphate salt.

Non-limiting examples of suitable reducing agents include sodium hydrosulfite, potassium hydrosulfite, sodium sulfite, potassium sulfite, sodium sulfate, potassium sulfate, sodium bisulfite, potassium bisulfite, sodium metasulfite, potassium metasulfite, sodium borohydride, or any combination thereof.

The reducing agent can be added to the fibers in an amount in a range between about 0.1 and about 2 wt. % based on the total weight of the fibers. In one aspect, the reducing agent is added to the fibers in an amount in a range between about 0.5 and about 1 wt. % based on the total weight of the fibers. In another aspect, the reducing agent is added to the fibers in an amount in a range between about 0.7 wt. % and about 1.7 wt. %. Yet, in another aspect, the reducing agent is added to the fibers in an amount about or in any range between about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, and 2.0 wt. % based on the total weight of the fibers.

The phosphate salt can be any suitable salt including phosphate. Non-limiting examples of suitable phosphate salts include aluminum phosphate, aluminum triphosphate, calcium phosphate, calcium triphosphate, sodium phosphate, potassium phosphate, potassium triphosphate, sodium triphosphate, or any combination thereof.

When used, the phosphate salt can be added to the fibers in an amount in a range between about 0.01 and about 2 wt. % based on the total weight of the fibers. In one aspect, the phosphate salt is added to the fibers in an amount in a range between about 0.5 and about 0.8 wt. % based on the total weight of the fibers. In another aspect, the phosphate salt is added to the fibers in an amount in a range between about 0.7 wt. % and about 1.0 wt. %. Yet, in another aspect, the phosphate salt is added to the fibers in an amount about or in any range between about 0.01, 0.05, 0.1, 0.2, 0.3, 0.4, 0.5, 0.6, 0.7, 0.8, 0.9, and 1.0 wt. % based on the total weight of the fibers.

The fiber mixture can be exposed to the brightening agent by any suitable method. For example, the brightening and shive reduction process can be performed in a conventional laboratory kier system or any commercial scale equipment. Kier-based systems can provide improved process performance and result in an increased brightness, shive reduction.

Once the brightness of the fibers has been sufficiently increased, and the shive content sufficiently reduced, the fibers can be rinsed to stop the reaction and to wash away loosened residual shive material. Optionally, the fibers can be subjected to additional chemical bleaching to increase brightness or mechanical processing to remove loosened shive material.

Additional bleaching/brightening stages can include use of a second or a third brightening agent(s) to further increase the brightness of the fibers. One or two stages of additional brightening can be used. For example, a peroxide compound combined with an alkaline compound can be used in a first stage, followed by a second stage of bleaching with a peroxide compound with alkaline compound or a reducing agent. Alternatively, the first additional bleaching stage can include a reducing agent, followed by a second stage with a peroxide compound and an alkaline agent.

The additional brightening agent(s) can be a peroxide compound, an alkaline compound, a reducing agent, a phosphate salt, or a combination thereof. The additional brightening agents can be added to the first brightening agent (the permanganate compound and/or the acid), or used in subsequent brightening stages. Oxygen gas can be added to the peroxide compound or in an oxygen-peroxide bleaching stage. For example, the peroxide can be hydrogen peroxide. The fibers can be exposed to the peroxide compound and then a reducing agent.

The brightened fibers can be used to make nonwoven fabrics and/or textiles according to conventional processes known to those skilled in the art. The nonwoven fabrics, textiles, and other products can include any amount of the brightened fibers disclosed herein. For example, nonwoven fabrics can include about or in any range between about 5, 10, 15, 20, 25, 30, 25, 40, 45, 50, 55, 60, 65, 70, 75, 80, 85, 90, 95, and 100 wt. % of the brightened fibers.

The nonwoven fabric described herein can be incorporated into a variety of textiles and products. Non-limiting examples of products include wipers (or wipes), such as wet wipers, dry wipers, or impregnated wipers, which include personal care wipers, household cleaning wipers, and dusting wipers. Personal care wipers can be impregnated with, e.g., emollients, humectants, fragrances, and the like. Household cleaning wipers or hard surface cleaning wipers can be impregnated with, e.g., surfactants (for example, quaternary amines), peroxides, chlorine, solvents, chelating agents, antimicrobials, fragrances, and the like. Dusting wipers can be impregnated with, e.g., oils.

Non-limiting examples of wipers include baby wipes, cosmetic wipes, perinea wipes, disposable washcloths, household cleaning wipes, such as kitchen wipes, bath wipes, or hard surface wipes, disinfecting and germ removal wipes, specialty cleaning wipes, such as glass wipes, mirror wipes, leather wipes, electronics wipes, lens wipes, and polishing wipes, medical cleaning wipes, disinfecting wipes, and the like. Additional examples of products include sorbents, medical supplies, such as surgical drapes, gowns, and wound care products, personal protective products for industrial applications, such as protective coveralls, sleeve protectors, and the like, protective coverings for automotive applications, and protective coverings for marine applications. The nonwoven fabric can be incorporated into absorbent cores, liners, outer-covers, or other components of personal care articles, such as diapers (baby or adult), training pants, feminine care articles (pads and tampons) and nursing pads. Further, the nonwoven fabric can be incorporated into fluid filtration products, such air filters, water filters, and oil filters, home furnishings, such as furniture backing, thermal and acoustic insulation products, agricultural application products, landscaping application products, and geotextile application products.

A nonwoven web of staple fibers can be formed by a mechanical process known as carding as described in U.S. Pat. No. 797,749, which is incorporated herein in its entirety by reference. The carding process can include an airstream component to randomize the orientation of the staple fibers when they are collected on the forming wire. A state of the art mechanical card, such as the Trützschler-Fliessner EWK-413 card, can run staple fibers having significantly shorter length than the 38 mm noted above. Older card designs may require longer fiber length to achieve good formation and stable operation.

Another common dry web forming process is air-laid or air-forming. This process employs only air flow, gravity, and centripetal force to deposit a stream of fibers onto a moving forming wire that conveys the fiber web to a web bonding process. Air-laid processes are described in U.S. Pat. Nos. 4,014,635 and 4,640,810, both of which are incorporated herein in their entirety by reference. Pulp-based air-formed nonwoven webs frequently incorporate thermoplastic fibers that melt and bond the air-laid web together when the air-formed web is passed through ovens.

Thermal bonding is also referred to as calendar bonding, point bonding, or pattern bonding, can be used to bond a fiber web to form a nonwoven fabric. Thermal bonding can also incorporate a pattern into the fabric. Thermal bonding is described in PCT International Publication No. WO/2005/025865, which is incorporated herein by reference in its entirety. Thermal bonding requires incorporation of thermoplastic fibers into the fiber web. Examples of thermoplastic fibers are discussed above. In thermal bonding, the fiber web is bonded under pressure by passing through heated calendar rolls, which can be embossed with a pattern that transfers to the surface of the fiber web. During thermal bonding, the calendar rolls are heated to a temperature at least between the glass transition temperature ($T_g$) and the melting temperature ($T_m$) of the thermoplastic material.

Brightened fibers are formed into an unbounded web in the wet or dry state. In one aspect, the web is formed by a method employing a mechanical card. In another aspect, the web is formed by a method employing a combination of a mechanical card and a forced air stream. The dry web can be bonded by hydro entangling, or hydroentanglement. In addition, the hydroentangled web can be treated with an aqueous adhesive and exposed to heat to bond and dry the web. Also, the dry web can be bonded by mechanical needle punching and/or passing a heated air stream through the web. Alternatively, the dry web can be bonded by applying an aqueous adhesive to the unbounded web and exposing the web to heat.

Hydroentanglement, also known as spunlacing, or spunbonding, to form non-woven fabrics and substrates is well-known in the art. Non-limiting examples of the hydroentangling process are described in Canadian Patent No. 841,938 and U.S. Pat. Nos. 3,485,706 and 5,958,186. U.S. Pat. Nos. 3,485,706 and 5,958,186, respectively, are incorporated herein in their entirety. Hydroentangling involves forming a fiber web, either wet-laid or dry-laid, and thereafter entangling the fibers by employing very fine water jets under high pressure. For example, a plurality of rows of waterjets are directed towards the fiber web which is disposed on a moving support, such as a wire (mesh). Hydroentangling of the fibers provides distinct hydroemboss patterns, which can create low fiber count zones, facilitate water dispersion, and provide a three dimensional structure. The entangled web is then dried.

A nonwoven fiber web of brightened fibers can be wet-laid or foam-formed in the presence of a dispersion agent. The dispersion agent can either be directly added to the fibers in the form of a so-called "fiber finish" or it can be added to the water system in a wet-laying or foam-forming process. The addition of a suitable dispersion agent assists in providing a good formation, i.e, substantially uniform fiber dispersion, of brightend fibers. The dispersion agent can be of many different types which provide a suitable dispersion effect on the brightened fibers or any mixture of such brightened fibers. A non-limiting example of a dispersion agent is a mixture of 75% bis(hydrogenerated tallow alkyl) dimethyl ammonium chloride and 25% propyleneglycol. The addition ought to be within the range of 0.01-0.1 weight %.

During foam-forming the fibers are dispersed in a foamed liquid containing a foam-forming surfactant and water, whereafter the fiber dispersion is dewatered on a support, e.g., a wire (mesh), in the same way as with wet-laying. After the fiber web is formed, the fiber web is subjected to hydroentanglement with an energy flux of about 23,000 foot-pounds per square inch per second or higher. The hydroentanglement is carried out using conventional techniques and with equipment supplied by machine manufacturers. After hydroentanglement, the material is pressed and dried and, optionally, wound onto a roll. The ready material is then converted in a known way to a suitable format and is packed.

The nonwoven fabric of the present invention can be incorporated into a laminate comprising the nonwoven fabric and a film. Laminates can be used in a wide variety of applications, such outer-covers for personal care products and absorbent articles, for example diapers, training paints, incontinence garments, feminine hygiene products, wound dressings, bandages, and the like.

To form a laminate, an adhesive is applied to a support surface of the nonwoven fabric or a surface of the film. Examples of suitable adhesives include sprayable latex, polyalphaolefin, (commercially available as Rextac 2730 and Rextac 2723 from Huntsman Polymers, Houston, Tex.), and ethylene vinyl acetate. Additional commercially available adhesives include, but are not limited to, those available from Bostik Findley, Inc., Wauwatosa, Wis. Then, a film is fed onto the forming wire on top of the nonwoven fabric. Before application to the nonwoven fabric, the film is stretched as desired. The nonwoven fabric and film are combined and compressed in a nip to form the laminate. Although not required for pressure sensitive adhesives, the nip can be maintained at a desired adhesive bonding temperature suitable for the adhesive employed, e.g. heat activated adhesions. The laminate can be cut, directed to a winder, or directed to further processing.

In addition to applying a film to the nonwoven fabric, another fabric can be bonded to the nonwoven fabric, which can be, for example another nonwoven fabric or a woven fabric. The nonwoven fabric can be a nonwoven fabric made in accordance with the present invention. An adhesive can be applied to either the nonwoven fabric or the another fabric before nipping to form the laminate.

The films used in laminates can include, but are not limited to, polyethylene polymers, polyethylene copolymers, polypropylene polymers, polypropylene copolymers, polyurethane polymers, polyurethane copolymers, styrene-butadiene copolymers, or linear low density polyethylene. Optionally, a breathable film, e.g. a film comprising calcium carbonate, can be employed to form the laminate. Generally, a film is "breathable" if it has a water vapor transmission rate of at least 100 grams/square meter/24 hours, which can be measured, for example, by the test method described in U.S.

Pat. No. 5,695,868, which is incorporated herein in its entirety by reference. Breathable films, however, are not limited to films comprising calcium carbonate. Breathable films can include any filler. As used herein, "filler" is meant to include particulates and other forms of materials which will not chemically interfere with or adversely affect the film, but will be substantially uniformly dispersed throughout the film. Generally, fillers are in particulate form and spherical in shape, with average diameters in the range between about 0.1 micrometers to about 7 micrometers. Fillers include, but are not limited to, organic and inorganic fillers.

Optionally, the brightening agent or the fiber mixture includes additives. Suitable additives include, but are not limited to, chelants, magnesium sulfate, surfactants, wetting agents, pH buffering agents, stabilizing additives, or any combination thereof.

The optional one or more additives can be present in a range between about 0.5 and about 5 wt. % based on the total weight of the mixture of non-wood fibers. In another aspect, one or more additives can be present in a range between about 1 and about 10 wt. %. Yet, in another aspect, one or more additives can be present in a range between about 2 and about 6 wt. %. Still yet, in another aspect, one or additives can be present in a range between about 3 and about 5 wt. %. In one aspect, the mixture of non-wood fibers can include one or more additives about or in any range between about 0.1, 0.2, 0.5, 0.7, 1, 2, 3, 4, 5, 6, 7, 8, 9, 10, 11, 12, 13, 14, 15, 16, 17, 18, 19, and 20 wt. %.

Suitable chelants include any metal sequestrant. Non-limiting examples of chelants include ethylenediamine-N, N'-disuccinic acid (EDDS) or the alkali metal, alkaline earth metal, ammonium, or substituted ammonium salts thereof, or mixtures thereof. Suitable EDDS compounds include the free acid form and the sodium or magnesium salt thereof. Examples of sodium salts of EDDS include $Na_2$EDDS and $Na_4$EDDS. Examples of such magnesium salts of EDDS include MgEDDS and $Mg_2$EDDS. Other chelants include the organic phosphonates, including amino alkylene poly (alkylene phosphonate), alkali metal ethane-1-hydroxy diphosphonates, nitrile-trimethylene phosphonates, ethylene diamine tetra methylene phosphonates, and diethylene triamine penta methylene phosphonates. The phosphonate compounds can be present either in their acid form or as a complex of either an alkali or alkaline metal ion, the molar ratio of the metal ion to phosphonate compound being at least 1:1. Other suitable chelants include amino polycarboxylate chelants such as EDTA.

Suitable wetting agents and/or cleaning agents include, but are not limited to, detergents and nonionic, amphoteric, and anionic surfactants, including amino acid-based surfactants. Amino acid-based surfactant systems, such as those derived from amino acids L-glutamic acid and other natural fatty acids, offer pH compatibility to human skin and good cleansing power, while being relatively safe and providing improved tactile and moisturization properties compared to other anionic surfactants.

Suitable buffering systems include any buffering agents that assist the buffering system in reducing pH changes. Illustrative classes of buffering agents include, but are not limited to, a salt of a Group IA metal including, for example, a bicarbonate salt of a Group IA metal, a carbonate salt of a Group IA metal, an alkaline or alkali earth metal buffering agent, an aluminum buffering agent, a calcium buffering agent, a sodium buffering agent, a magnesium buffering agent, or any combination thereof. Suitable buffering agents include carbonates, phosphates, bicarbonates, citrates, borates, acetates, phthalates, tartrates, succinates of any of the foregoing, for example sodium or potassium phosphate, citrate, borate, acetate, bicarbonate and carbonate, or any combination thereof. Non-limiting examples of suitable buffering agents include aluminum-magnesium hydroxide, aluminum glycinate, calcium acetate, calcium bicarbonate, calcium borate, calcium carbonate, calcium citrate, calcium gluconate, calcium glycerophosphate, calcium hydroxide, calcium lactate, calcium phthalate, calcium phosphate, calcium succinate, calcium tartrate, dibasic sodium phosphate, dipotassium hydrogen phosphate, dipotassium phosphate, disodium hydrogen phosphate, disodium succinate, dry aluminum hydroxide gel, magnesium acetate, magnesium aluminate, magnesium borate, magnesium bicarbonate, magnesium carbonate, magnesium citrate, magnesium gluconate, magnesium hydroxide, magnesium lactate, magnesium metasilicate aluminate, magnesium oxide, magnesium phthalate, magnesium phosphate, magnesium silicate, magnesium succinate, magnesium tartrate, potassium acetate, potassium carbonate, potassium bicarbonate, potassium borate, potassium citrate, potassium metaphosphate, potassium phthalate, potassium phosphate, potassium polyphosphate, potassium pyrophosphate, potassium succinate, potassium tartrate, sodium acetate, sodium bicarbonate, sodium borate, sodium carbonate, sodium citrate, sodium gluconate, sodium hydrogen phosphate, sodium hydroxide, sodium lactate, sodium phthalate, sodium phosphate, sodium polyphosphate, sodium pyrophosphate, sodium sesquicarbonate, sodium succinate, sodium tartrate, sodium tripolyphosphate, synthetic hydrotalcite, tetrapotassium pyrophosphate, tetrasodium pyrophosphate, tripotassium phosphate, trisodium phosphate, trometarnol, or any combination thereof.

Optionally, one or more stabilizing additives can be added during the bleaching or brightening process to prevent hydrogen peroxide decomposition. Non-limiting examples of suitable stabilizing additives include sodium silicate, magnesium sulfate, diethylene triamine penta acetic acid (DTPA), DTPA salts, ethylene diamine tetra acetic acid (EDTA), EDTA salts, or any combination thereof.

The brightened fibers of the present invention can be used for any paper or tissue product, including but not limited to, tissue products made in a wet laid paper machine. In one aspect, a tissue or a paper comprises non-wood fibers having a brightness greater than about 65 as measured by MacBeth UV-C standard.

The tissue paper can include any additional papermaking fibers, thermoplastic fibers, and/or synthetic fibers, and produced according to the Conventional Wet Press (CWP) manufacturing method, or by the Through Air Drying (TAD) manufacturing method, or any alternative manufacturing method (e.g., Advanced Tissue Molding System ATMOS of the company Voith, or Energy Efficient Technologically Advanced Drying eTAD of the company Georgia-Pacific). The web can be dried on a Yankee dryer and can be creped or un-creped.

The tissue or paper can include any amount of the brightened fibers disclosed herein. For example, tissues and papers can include about or in any range between about 5, 10, 15, 20, 25, 30, 25, 40, 45, 50, 55, 60, 65, 70, 75, 80, 85, 90, 95, and 100 wt. % of the brightened fibers.

For example, conventional wet pressed tissues are prepared by first preparing and mixing the raw fiber material in a vat to produce a fiber slurry. Then, the fiber slurry is transferred through a centrifugal pump to a headbox. From the headbox, the fibrous mixture is deposited onto a moving foraminous wire, such as Fourdrinier wire, to form a nascent web. Water can drain through the wire by use of vacuum and/or drainage elements. The web can then be dried by any suitable methods, including, but not limited to, air-drying, through-air drying (TAD), or drying on a Yankee dryer. For drying on a Yankee dryer, first an adhesive material is sprayed onto the surface of the Yankee dryer. The nascent web is transferred onto the hot Yankee dryer via one or two press rolls. The web is dried on the Yankee dryer and then removed with a creping doctor, which scrapes the web from the surface of the Yankee dryer drum. Then, the dried web is wound into a roll at the reel of the paper machine.

When used to form tissues or paper, the fiber slurry can include any additional additives known in the art, including, but not limited to, wet strength agents, debonders, surfactants, or any combination thereof.

EXAMPLES

In the following examples, unbleached flax fibers were used to assess the impact of the combination of potassium permanganate and an acid on shive content and brightness. All brightness measurements were conducted on thick pads of flax fiber. The pads were generated by diluting a sample of the flax fibers to approximately 2% consistency with water. The flax samples were gently hand mixed to separate the fibers as much as possible and then dewatered on a Buchner funnel with a piece of filter paper to form the fiber pad. During dewatering, the flax fiber was manually distributed to form as uniform a pad as possible. Then the pad was removed from the Buchner funnel and pressed between blotters in a laboratory press machine for about 10 minutes under a maximum pressure of 3,000 PSI. The fiber pads were then dried on a speed dryer until substantially dry. Care was taken to avoid overheating the samples because any potential excess heat induced yellowing. The fiber pads were air-dried for several days prior to brightness testing. All brightness tests were conducted in accordance with the MacBeth UV-C test method.

Example 1

Unbleached flax samples were processed using a 1 wt. % dose of potassium permanganate solution (0.1 normal (N) 0.0158 g/ml standard potassium permanganate solution). 30 g of unbleached flax fiber was placed in a 1 L glass beaker. A solution containing the potassium permanganate (K) dose was prepared in water to provide an 8% consistency. The solution was added to the beaker and mixed by hand stirring for about 10-15 seconds, and then the beaker was placed in a 150° F. water bath for 15 minutes. The mixture was mixed every 5 minutes while in the bath.

K(1) (see Table 1 below) was run without any pH adjustment. The pH of K(2) and K(3) was adjusted by adding 1 milliliter (mL) and 2 mL, respectively, of 5 N sulfuric acid solution. After 15 minutes of retention, the samples were rinsed with cold tap water (4×1 L) on a Buchner funnel.

Samples of the processed flax were retained for brightness measurements. The remaining portions of the flax samples were bleached using hydrogen peroxide (P), followed by a rinse and either a second hydrogen peroxide stage (P/P sequence) or a sodium hydrosulfite stage (P/Y sequence).

The peroxide bleaching was performed using a modified "spinner" method. In this method, about 30 g oven dry (OD) fiber was added to a 4 L beaker. Distilled water and the indicated chemicals were added to bring the pulp to about an 8% consistency. The beakers were then placed in a 190° F. water bath about 80% submerged. Instead of continuously agitating the fibers with a motorized spinner, the samples were manually mixed (using a spoon) at approximately 10 minute intervals throughout the 180 minute duration of bleaching. A small amount of sodium silicate, 0.2 wt. % on pulp, was also added to the samples to help stabilize hydrogen peroxide.

The hydrosulfite bleaching stage (reducing stage) was performed using a "bag" bleaching method. In this method, flax samples were placed in a zip-lock style plastic bag and maintained at a constant temperature in a water bath for the bleaching process duration. Thirty OD grams of fiber were diluted to about a 12% consistency using distilled water and placed in a zip-lock type bag. The samples were then placed in a sealed glove box, and nitrogen was used to purge the oxygen. Nitrogen was purged into the box for approximately 15 minutes. While under nitrogen purge, the specified sodium hydrosulfite charge was prepared by weighing the required hydrosulfite powder, adding 25 mL of distilled water to dissolve the powder, and then adding the composition to the flax sample. The bags were sealed and hand kneaded to mix the sodium hydrosulfite. The sealed bags were then removed from the glove box and placed in a 180° F. water bath for 60 minutes. Mixing was performed at 30 minute intervals for the remaining retention time. The samples were then removed from the water bath, and brightness pads of fibers were prepared as detailed above.

As shown in Table 1, a substantial improvement in flax brightness occurred when using the acidic potassium permanganate conditions (K). For comparison, the same unbleached flax samples achieved a 60.2 peroxide brightness (P) and a 67.5 two stage peroxide brightness (P/P) (Table 2) using the same bleaching conditions.

As shown in Table 2, lower brightness was observed in the peroxide/hydrosulfite sequence (P/Y) as a result of brightness reversion seen after exposing the hydrosulfite treated flax to oxygen in the air.

TABLE 1

Potassium permanganate and single stage peroxide bleach

| | | | K | | | | P | | | |
|---|---|---|---|---|---|---|---|---|---|---|
| Permanganate Sample ID | % OP | pH | Brightness | L* | a* | b* | Brightness | L* | a* | b* |
| K (1) 4-18 | 1 | 9.2 | 27.3 | 64.9 | 1.2 | 10.1 | 35.9 | 73.5 | 0.4 | 12.7 |
| K (2) 4-18 | 1 | 3.0 | 33.9 | 70.2 | 1.1 | 9.5 | 70.0 | 92.2 | −0.9 | 9.3 |
| K (3) 4-18 | 1 | 2.7 | 34.1 | 69.8 | 1.2 | 8.5 | 72.6 | 92.7 | −0.8 | 8.0 |

TABLE 2

Examples 1-3 (two stage peroxide and peroxide/hydrosulfite)

| | P/Y | | | | P/P | | | |
|---|---|---|---|---|---|---|---|---|
| Sample ID | Brightness | L* | a* | b* | Brightness | L* | a* | b* |
| K (1) 4-18 | 41.0 | 74.8 | 0.7 | 8.3 | 43.9 | 78.6 | 0.0 | 11.5 |
| K (2) 4-18 | 65.5 | 89.5 | −0.3 | 8.6 | 77.2 | 94.4 | −1.6 | 7.4 |
| K (3) 4-18 | 62.5 | 88.9 | −0.4 | 10.4 | 78.5 | 94.7 | −1.4 | 6.5 |

Example 2

In the next set of experiments, a dose curve was run to compare the brightness response with permanganate dose in the pre-treatment step. All samples were treated for 30 minutes at 180° F. and 6% consistency using the procedure described in Example 1. Due to the lower consistency, 5 mL of 5N sulfuric acid was added to each sample to ensure that the pH remained below 3.

The potassium permanganate stage brightness (K) for each sample is provided below, which shows that the brightness peaked with the K(5) sample (5% OP potassium permanganate).

TABLE 3

Comparison of effect of potassium permanganate dose

| Permanganate | Initial | | K | | | |
|---|---|---|---|---|---|---|
| Sample ID | % OP | pH | Brightness | L* | a* | b* |
| K (1) | 1 | 12.5 | 31.83 | 68.5 | 1.39 | 9.4 |
| K (2) | 2 | 2.4 | 37.89 | 73.8 | 1 | 10.5 |
| K (3) | 3 | 2.4 | 37.72 | 74.9 | 1.27 | 11.2 |
| K (5) | 5 | 2.4 | 39.09 | 74.9 | 1.04 | 10.8 |
| K (7) | 7 | 2.5 | 34.34 | 72.2 | 1.37 | 12.4 |
| K (10) | 10 | 2.5 | 36.78 | 74.3 | 1.16 | 12.8 |

Example 3

The samples from Example 2 were post-bleached using single peroxide (P), double peroxide (P/P), peroxide/hydrosulfite (P/Y), hydrosulfite (Y), and hydrosulfite/peroxide (Y/P) sequences. All peroxide stages were performed using 3% hydrogen peroxide on pulp, 2% NaOH on pulp, 1% sodium silicate on pulp, and 0.1% diethylene triamine pentaacetic acid (DTPA) on pulp. Samples were run at 8% consistency, 180° F., and for 60 minutes. All hydrosulfite stages were run with 1% sodium hydrosulfite on pulp, 5% consistency, 180° F., and for 60 minutes retention.

TABLE 4

Peroxide and hydrosulfite post-bleaching of Example 2 samples

| | P | | | | Y | | | |
|---|---|---|---|---|---|---|---|---|
| Initial Sample ID | Brightness | L* | a* | b* | Brightness | L* | a* | b* |
| K (1) | 62.85 | 89.2 | −0.54 | 10.5 | 35.5 | 70.89 | 0.69 | 8.51 |
| K (2) | 66.56 | 90.2 | −0.55 | 8.83 | 38.55 | 73.77 | 0.81 | 8.49 |
| K (3) | 66.52 | 90.3 | −0.59 | 9 | 42.85 | 73.25 | 0.74 | 8.59 |
| K (5) | 62.64 | 87.2 | 0.11 | 7.15 | 44.16 | 76.5 | 0.56 | 7.48 |
| K (7) | 51.27 | 81.8 | −0.01 | 8.93 | 48.29 | 79.8 | 0.54 | 8.61 |
| K (10) | 47.76 | 80.1 | 0.12 | 9.8 | 46.19 | 78.71 | 0.55 | 9.06 |

The brightness and color results are provided in Tables 4 and 5. The optimal brightness was seen for the K(3) (3% K on pulp) samples for the peroxide and peroxide/peroxide (P/P) sequences. Further, the reversion seen in the hydrosulfite stages resulted in a lower overall brightness.

TABLE 5

Dual stage post-bleaching of Example 2 samples

| Sample ID | Brightness | L* | a* | b* | Brightness | L* | a* | b* | Brightness | L* | a* | b* |
|---|---|---|---|---|---|---|---|---|---|---|---|---|
| K (1) | 61.18 | 88 | −0.55 | 9.89 | 70.47 | 91.8 | −0.99 | 8.27 | 57.81 | 86.2 | −0.63 | 9.94 |
| K (2) | 66.63 | 90.1 | −0.69 | 8.59 | 69.91 | 91.4 | −1.39 | 8.19 | 63.29 | 88.4 | −0.65 | 8.66 |
| K (3) | 70.36 | 90.9 | −0.8 | 6.7 | 76.96 | 93.7 | −1 | 6.1 | 67.02 | 89.6 | −0.56 | 7.39 |
| K (5) | 66.2 | 89 | −0.25 | 6.97 | 71.49 | 91.7 | −0.74 | 7.13 | 65.29 | 89.3 | −0.6 | 8.45 |
| K (7) | 63.02 | 86.8 | −0.17 | 6.09 | 60.54 | 8674 | −0.28 | 8.3 | 70.87 | 91.3 | −0.45 | 6.96 |
| K (10) | 67.04 | 89 | −0.25 | 6.23 | 51.14 | 82 | −0.13 | 9.42 | 68.11 | 89.8 | −0.34 | 6.68 |

Example 4

Residual peroxide and pH measurements for each of the bleaches from Example 3 were assessed (Table 6). As shown, the drop off in optimal peroxide residual in the K(5), K(7), and K(10) samples (compare K(3) and K(5)) correlated with lower brightness in these higher dose samples.

TABLE 6

Residual peroxide and pH measurements on Example 3 samples

| | P Stage | | P/P Stage | | Y/P Stage | |
|---|---|---|---|---|---|---|
| Sample ID | Final pH | Residual $H_2O_2$ g/l | Final pH | Residual $H_2O_2$ g/l | Final pH | Residual $H_2O_2$ g/l |
| K (1) | 11.59 | 1.53 | 11.38 | 1.33 | 11.7 | 0.54 |
| K (2) | 11.46 | 1.53 | 11.43 | 1.39 | 11.7 | 0.65 |
| K (3) | 11.33 | 1.19 | 11.45 | 1.43 | 11.7 | 0.71 |
| K (5) | 11.53 | 0.07 | 12.19 | 0.00 | 12.0 | 0.31 |
| K (7) | 11.47 | 0.07 | 12.25 | 0.00 | 12.2 | 0.20 |
| K (10) | 11.53 | 0.03 | 12.27 | 0.00 | 12.3 | 0.00 |

Example 5

During the experiments, it was also observed that the higher permanganate doses (above 5%) resulted in dark spots or deposits on the fibers, although the majority of the fibers bleached well (compare FIGS. 1A and 1B with 2A and 2B). Fiber samples containing bleached and dark areas were analyzed to identify the cause of the dark coloring.

Attenuated Total Reflectance (ATR) Fourier Transform-Infrared Spectroscopy (FTIR) was performed on the samples via a Nicolet 6700 FTIR bench spectrometer with a Smart iTR accessory and a diamond crystal plate. The FTIR analysis of the white and dark areas showed no difference between the two samples. In addition, an attempt to dissolve the brown material into chloroform for further analysis was unsuccessful.

An elemental analysis was performed by Energy Dispersive Spectroscopy (EDS) with a Scanning Electron Microscope (SEM). The samples were ashed at 525° C. prior to analysis. As shown in Table 7, the dark spots contained high levels of manganese, which indicated that the dark spots were due to precipitated manganese dioxide on the fibers.

TABLE 7

Elemental analysis of ashed (525° C.) samples

| Elemental Analysis[a] | Control (White) Area | Contaminated (Dark) Area |
|---|---|---|
| Mn | 1.38 | 46.64 |
| O | 35.73 | 24.48 |
| Ca | 36.07 | 12.68 |
| C | 8.60 | 5.58 |
| Mg | 4.79 | 2.73 |
| Si | 3.95 | 3.66 |
| S | 1.34 | 0.20 |
| Na | 2.58 | 0.54 |
| Al | 0.86 | 0.63 |
| P | 0.62 | 0.81 |
| K | 1.32 | 0.58 |
| Fe | 0.84 | 0.85 |
| Cu | 0.81 | 0.38 |
| Ti | 0.32 | N.D.[b] |
| Zn | 0.78 | N.D. |
| Cl | N.D. | 0.23 |

Figure 9A:
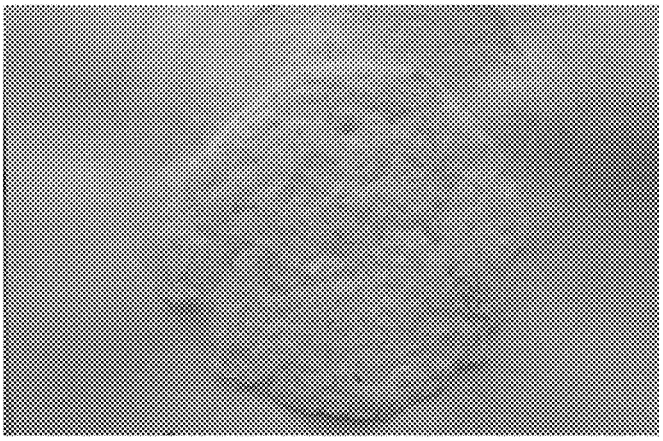
FIGS. 9A and 9B are low and high magnification photomicrographs, respectively, the fibers of FIGS. 8A and 8B after a single stage peroxide bleach.
Figure 9B:
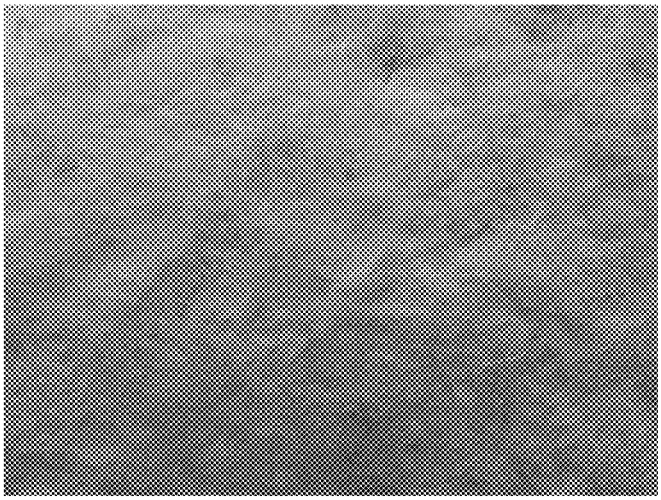
Figure 10A:
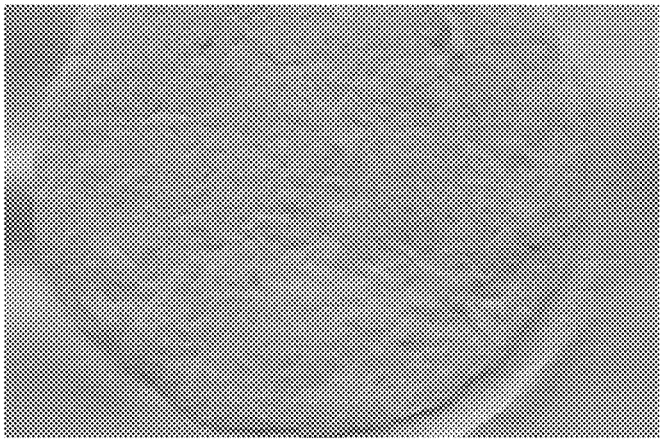
FIGS. 10A and 10B are low and high magnification photomicrographs, respectively, of the fibers of FIGS. 8A and 8B after a double stage peroxide bleach.
Figure 10B:
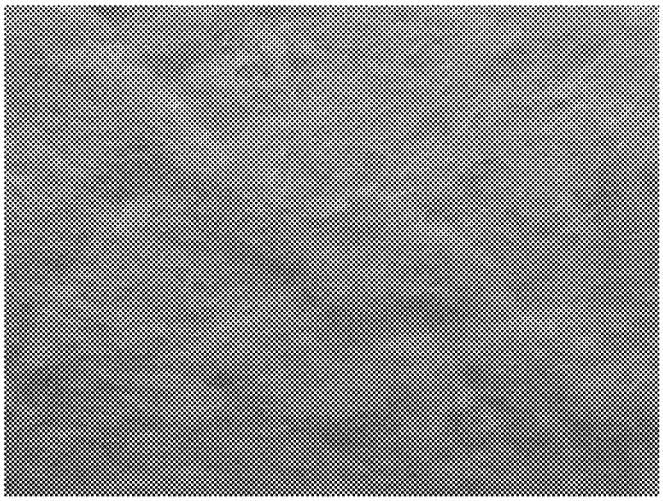

[a]Results are reported on the ashed basis, are semi-quantitative and have been normalized.
[b]N.D. means not detected.

from Example 4 above for comparison. The addition of a small amount of reducing agent significantly reduced the presence of black precipitate and resulted in an increased brightness. While sodium sulfite and sodium sulfate resulted in higher brightness than the control, sodium bisulfite (520K (3)) resulted in a significantly higher brightness and significantly lowers the observed dark precipitate (see low and high magnification views of the fibers in FIGS. 8A and 8B, respectively). After a single stage peroxide bleach (P), the sodium bisulfite treated sample demonstrated an even higher brightness with even less precipitate being visible (see low and high magnification views in FIGS. 9A and 9B, respectively). A double stage peroxide bleach (PIP) provided even higher brightness with decreased precipitate than the single stage (see low and high magnification views in FIGS. 10A and 10B, respectively).

Figure 11A:
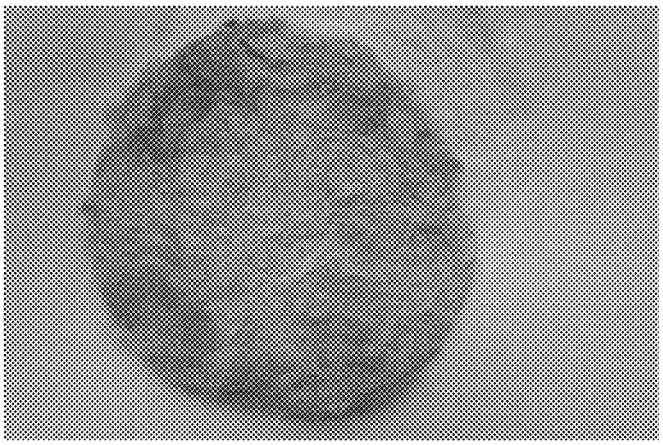
FIGS. 11A and 11B are low and high magnification photomicrographs, respectively, of fibers brightened without a reducing agent.
Figure 11B:
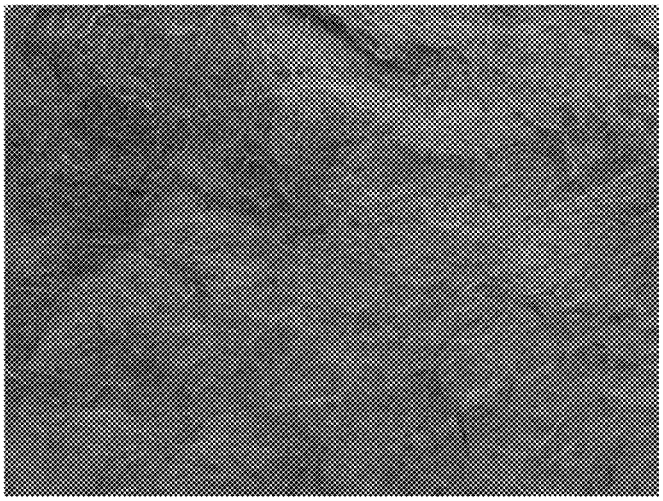
Figure 12A:
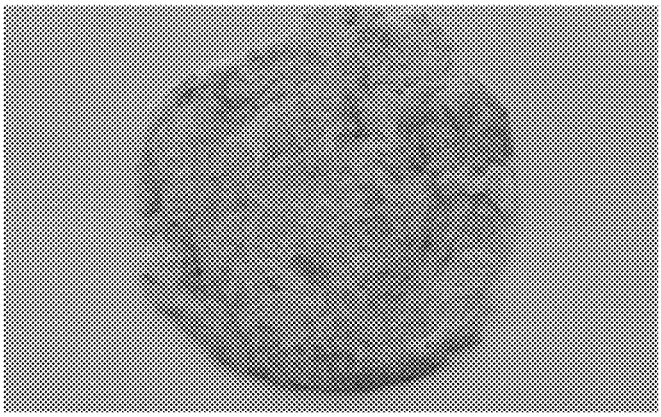
FIGS. 12A and 12B are low and high magnification photomicrographs, respectively, of the fibers of FIGS. 11A and 11B after a double stage peroxide bleach.
Figure 12B:
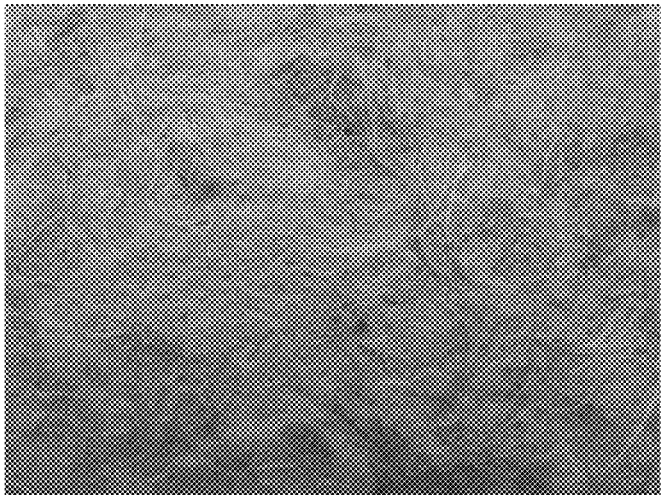

For comparison, absence of a reducing agent (K10) provided a much lower brightness with increased visual levels of precipitate (see low and high magnification views of the fibers in FIGS. 11A and 11B, respectively). A subsequent double stage peroxide bleach (PIP), however, provided an increase in brightness, yet at a reduced level compared to with the sodium bisulfate treatment (see low and high magnification view in FIGS. 12A and 12B, respectively).

TABLE 8

Effect of adding a reducing agent after the potassium permanganate stage

| | | | | | K | | | | P | | | | P/P | | | |
|---|---|---|---|---|---|---|---|---|---|---|---|---|---|---|---|---|
| | KMnO4 | Reducing Agent | | | Bright- | | | | Bright- | | | | Bright- | | | |
| Sample ID | % OP | Sulfate | Sulfite | Bisulfite | ness | L* | a* | b* | ness | L* | a* | b* | ness | L* | a* | b* |
| 520K(1) | 10 | X | | | 39.83 | 74.27 | 0.70 | 10.13 | 64.00 | 87.49 | −0.30 | 6.37 | 62.00 | 87.21 | −0.25 | 7.75 |
| 520K(2) | 10 | | X | | 39.88 | 75.49 | 0.96 | 10.91 | 52.23 | 82.26 | 0.07 | 8.75 | 45.25 | 77.43 | −0.10 | 7.94 |
| 520K(3) | 10 | | | X | 50.35 | 82.01 | 0.32 | 10.27 | 72.09 | 90.89 | −0.33 | 5.20 | 79.15 | 93.95 | −0.05 | 4.81 |
| K(10) | 10 | No Reduction | | | 36.78 | 74.30 | 1.16 | 12.80 | 47.76 | 80.10 | 0.12 | 9.80 | 51.14 | 82.00 | −0.13 | 9.42 |

Example 6

Based on the chemistry of permanganate, a series of experiments (520L) were performed to identify a method to minimize the precipitation. The first set of experiments used a 10% potassium permanganate dose, with the conditions being the same as the above examples, but added a 1% on pulp dose of a reducing agent at the end of the potassium permanganate stage. The reducing agent was mixed with the pulp and retained for 5 minutes prior to washing the fiber. The pulps were then single and double stage peroxide bleached (P and PIP), under the same conditions as the above examples.

Table 8 below provides the results of adding the reducing agent, along with sample K(10) without a reducing agent

Example 7

Experiments were performed to compare the use of sodium metabisulfite to the other reducing compounds. The potassium permanganate (K) and peroxide stages (P) were performed as described in the above examples. As shown in Table 9, the metabisulfite treatment provided higher brightness at the highest permanganate dose (10% OP) compared to the non-reducing agent series but did not provide as high a brightness as the sodium bisulfite treated fibers.

Furthermore, it was noted that the color of the P stage filtrate correlated with the sample brightness. The 79K(3) sample had a dark filtrate, the 79K(6) sample was lighter in color, and the 79K(10) was very light, almost clear, in color. This correlation between the filtrate color and brightness result was seen in all of the subsequent bleaching work.

TABLE 9

Effect of sodium metabisulfate on brightness

| | | Sodium | K | | | | P | | | | | Res |
|---|---|---|---|---|---|---|---|---|---|---|---|---|
| Sample ID | KMnO4 % OP | Metabisulfite % OP | Bright-ness | L* | a* | b* | Bright-ness | L* | a* | b* | Final pH | H2O2 g/l |
| 79K(3) | 3 | 2 | 39.71 | 75.26 | 1.41 | 10.68 | 62.86 | 88.50 | −0.50 | 9.20 | 11.2 | 1.7 |
| 79K(6) | 6 | 2 | 32.58 | 70.31 | 1.95 | 11.53 | 63.11 | 89.00 | −0.62 | 9.86 | 11.3 | 1.5 |
| 79K(10) | 10 | 2 | 35.32 | 72.67 | 1.82 | 11.87 | 70.27 | 90.98 | −0.78 | 6.79 | 11.3 | 1.1 |
| K(3) | 3 | 0 | 38.72 | 74.86 | 1.27 | 11.23 | 66.52 | 90.27 | −0.59 | 9.00 | 11.3 | 1.2 |
| K(7) | 7 | 0 | 34.34 | 72.20 | 1.37 | 12.40 | 51.27 | 81.80 | −0.01 | 8.93 | 11.5 | 0.1 |
| K(10) | 10 | 0 | 36.78 | 74.28 | 1.16 | 12.79 | 47.76 | 80.10 | 0.12 | 9.80 | 11.5 | 0.0 |

The effect of different acids for pH control in the potassium permanganate stage was assessed. A 5% potassium permanganate dose was used. As shown in Table 10, citric acid provided the lowest K stage and P stage brightness (significant dark stains were also observed on the fibers). Acetic, oxalic, and phosphoric acids performed better than citric acid and sulfuric acid, but some dark stains and deposits also were observed on the acetic and phosphoric acid samples. However, the oxalic acid sample showed no noticeable dark stains on the fiber and provided the highest P stage brightness.

The peroxide stage brightness for the 723 KSTP and 723 KSP was 74.9 and 76.8, respectively. For comparison, the same unbleached flax sample achieved a 60.2 peroxide brightness (P) and a 67.5 two stage peroxide brightness (P/P) using the conventional peroxide bleaching conditions. Furthermore, the very high peroxide residual for the samples indicated significant improvement in peroxide bleaching efficiency (as brightness gain is proportional to residual peroxide).

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A method of increasing the brightness of non-wood fibers, the method comprising:

TABLE 10

Effect of different acids on brightness

| | 5N | | Sodium | K | | | | P | | | | | Residual |
|---|---|---|---|---|---|---|---|---|---|---|---|---|---|
| Sample ID | KMnO4 % OP | H2SO4 ml | Metabisulfite % OP | Bright-ness | L* | a* | b* | Bright-ness | L* | a* | b* | Final pH | H2O2 g/l |
| 723 KC5 | 5 | Citric | 1 | 33.4 | 71.1 | 1.5 | 11.8 | 61.4 | 88.4 | −0.7 | 10.4 | 10.2 | 0.5 |
| 723 KA5 | 5 | Acetic | 1 | 40.0 | 76.3 | 1.2 | 12.2 | 64.4 | 88.8 | −0.7 | 8.3 | 10.1 | 1.1 |
| 723 KO5 | 5 | Oxalic | 1 | 40.5 | 77.0 | 1.6 | 12.9 | 67.5 | 90.5 | −0.9 | 8.5 | 9.9 | 1.9 |
| 723 KP5 | 5 | Phosphoric | 1 | 43.7 | 77.9 | 1.0 | 10.6 | 64.5 | 89.1 | −0.8 | 8.8 | 10.0 | 1.4 |
| 79K(6) | 6 | Sulfuric | 2 | 32.6 | 70.3 | 2.0 | 11.5 | 63.1 | 89.0 | −0.6 | 9.9 | 11.3 | 1.5 |

Example 8

Phosphate compounds in the potassium permanganate stage were used to minimize dark staining and precipitation. The potassium permanganate stage (K) was performed as above and utilized sulfuric acid to adjust the pH to a range between 2 and 3.

In the first sample (723 KSTP), 0.1% on pulp of sodium triphosphate was added to the K stage. In the second sample (723 KSP), 0.01% on pulp sodium phosphate was added to the K stage. As shown in Table 11 below, a significant increase in both brightness response and residual peroxide (lower peroxide consumption) was observed. In addition the fibers were substantially free of dark precipitate and/or stains.

TABLE 11

Effect of phosphate compounds on brightness

| | 5N | | | | Sodium | K | | | | P | | | | | Res |
|---|---|---|---|---|---|---|---|---|---|---|---|---|---|---|---|
| Sample ID | KMnO4 % OP | $H_2SO_4$ ml | Triphosphate % OP | Phosphate % OP | Metabisulfite % OP | Bright-ness | L* | a* | b* | Bright-ness | L* | a* | b* | Final pH | $H_2O_2$ g/l |
| 723 KSTP | 5 | Sulfuric | 0.01 | | 1 | 44.0 | 78.7 | 0.8 | 11.6 | 74.9 | 93.0 | −0.7 | 6.7 | 9.7 | 2.7 |
| 723 KSP | 5 | Sulfuric | | 0.01 | 1 | 50.5 | 82.2 | 0.1 | 10.5 | 76.8 | 93.4 | −0.7 | 5.8 | 9.8 | 2.2 |

forming a mixture of non-wood fibers having a mean length of about 5 to about 95 millimeters (mm) and a consistency of about 5% to about 10%; and exposing the mixture to a brightening agent, the brightening agent comprising a permanganate compound and an acid, having a pH of about 2 to about 3, and comprising about 1 to about 10 weight % of the permanganate compound based on dry weight of the non-wood fibers;

wherein the brightened fibers have a brightness greater than the fibers of the mixture before exposure as measured by MacBeth UV-C standard.

2. The method of claim 1, wherein the permanganate compound is selected from the group consisting of potassium permanganate, sodium permanganate, or any combination thereof.

3. The method of claim 1, wherein the acid is selected from the group consisting of acetic acid, carbonic acid, chloric acid, citric acid, formic acid, hydrobromic acid, hydrocyanic acid, hydroiodic acid, nitric acid, nitrous acid, oxalic acid, peraetic acid, phosphoric acid, phosphorous acid, sulfuric acid, or any combination thereof.

4. The method of claim 1, wherein the mixture is exposed to the brightening agent at a temperature in a range between about 20 and about 80° C.

5. The method of claim 1, wherein the non-wood fibers are selected from the group consisting of flax fibers, hemp fibers, jute fibers, ramie fibers, nettle fibers, Spanish broom fibers, kenaf plant fibers, cotton fibers, or any combination thereof.

6. The method of claim 1, wherein the mixture is exposed to the brightening agent for a time in a range between about 1 and about 30 minutes.

7. The method of claim 1, further comprising exposing the brightened fibers to a reducing agent, a phosphate salt, or both the reducing agent and the phosphate salt.

8. The method of claim 7, wherein the reducing agent is selected from the group consisting of sodium hydrosulfite, potassium hydrosulfite, sodium sulfite, potassium sulfite, sodium sulfate, potassium sulfate, sodium bisulfite, potassium bisulfite, sodium metasulfite, potassium metasulfite, sodium borohydride, or any combination thereof.

9. The method of claim 7, wherein the reducing agent is present in a range between about 0.1 and about 2 wt. % based on the total weight of the fibers.

10. The method of claim 7, wherein the phosphate salt is selected from the group consisting of aluminum phosphate, aluminum triphosphate, calcium phosphate, calcium triphosphate, sodium phosphate, potassium phosphate, potassium triphosphate, sodium triphosphate, or any combination thereof.

11. The method of claim 7, wherein the phosphate salt is added to the mixture in a range between about 0.01 wt. % and about 1 wt. % based on the total weight of the fibers.

12. The method of claim 1, further exposing the brightened fibers to at least a second brightening agent.

13. The method of claim 12, wherein the at least second brightening agent is selected from the group consisting of a peroxide compound, an alkaline compound, a reducing agent, or any combination thereof.

14. The method of claim 13, wherein the peroxide compound is hydrogen peroxide.

15. The method of claim 14 further comprising exposing the brightened fibers to oxygen gas.

16. The method of claim 1, further comprising exposing the brightened fibers to a peroxide compound and then a reducing agent.

17. The method of claim 1, further comprising carding the brightened fibers to form a nonwoven fabric.

18. The method of claim 1, further comprising forming a nonwoven fabric comprising the brightened fibers.

19. The method of claim 18, wherein the nonwoven fabric is selected from the group consisting of a wet wipe, a dry wipe, or an impregnated wipe.

20. The method of claim 18, wherein the nonwoven fabric is selected from the group consisting of a tissue, a facial tissue, a bath tissue, a baby wipe, a personal care wipe, a personal protective wipe, a cosmetic wipe, a perinea wipe, a disposable washcloth, a kitchen wipe, an automotive wipe, a bath wipe, a hard surface wipe, a cleaning wipe, a disinfecting wipe, a glass wipe, a mirror wipe, a leather wipe, an electronics wipe, a lens wipe, a polishing wipe, a medical cleaning wipe, or a disinfecting wipe.

21. The method of claim 1, further comprising hydrogen tangling the brightened fibers to form a nonwoven fabric.

22. The method of claim 1, further comprising spun bonding the brightened fibers to form a nonwoven fabric.

23. The method of claim 1, further comprising forming a tissue or a paper comprising the brightened fibers.

24. The method of claim 1, further comprising, prior to forming the mixture, retting the non-wood fibers.

25. The method of claim 24, further comprising, subsequent to retting and prior to forming the mixture, scouring the non-wood fibers.

26. The method of claim 24, further comprising, subsequent to exposing the mixture to the brightening agent, scouring the non-wood fibers.

27. A method of reducing the amount of residual shive in non-wood fibers, the method comprising:

forming a mixture of non-wood fibers having a mean length of about 5 to about 95 millimeters (mm) and a consistency of about 5-% to about 10%; and exposing the mixture to a brightening agent to produce low-shive fibers, the brightening agent comprising a permanganate compound and an acid, having a pH of about 2 to about 3, and comprising about 1 to about 10 weight % of the permanganate compound based on dry weight of the non-wood fibers;

wherein the low-shive fibers have less visible shive content than the fibers of the mixture before exposure.

28. The method of claim 27, wherein the permanganate compound is selected from the group consisting of potassium permanganate, sodium permanganate, or any combination thereof.

29. The method of claim 27, wherein the acid is selected from the group consisting of acetic acid, carbonic acid, chloric acid, citric acid, formic acid, hydrobromic acid, hydrocyanic acid, hydroiodic acid, nitric acid, nitrous acid, oxalic acid, peraetic acid, phosphoric acid, phosphorous acid, sulfuric acid, or any combination thereof.

30. The method of claim 27, wherein the mixture is exposed to the brightening agent at a temperature in a range between about 20 and about 80° C.

31. The method of claim 27, wherein the non-wood fibers are selected from the group consisting of flax fibers, hemp fibers, jute fibers, ramie fibers, nettle fibers, Spanish broom fibers, kenaf plant fibers, cotton fibers, or any combination thereof.

32. The method of claim 27, wherein the mixture is exposed to the brightening agent for a time in a range between about 1 and about 30 minutes.

33. The method of claim 27, further comprising exposing the brightened fibers to a reducing agent, a phosphate salt, or both the reducing agent and the phosphate salt.

34. The method of claim 33, wherein the reducing agent is selected from the group consisting of sodium hydrosulfite, potassium hydrosulfite, sodium sulfite, potassium sulfite, sodium sulfate, potassium sulfate, sodium bisulfite, potassium bisulfite, sodium metasulfite, potassium metasulfite, sodium borohydride, or any combination thereof.

35. The method of claim 33, wherein the reducing agent is present in a range between about 0.1 and about 2 wt. % based on the total weight of the fibers.

36. The method of claim 33, wherein the phosphate salt is selected from the group consisting of aluminum phosphate, aluminum triphosphate, calcium phosphate, calcium triphosphate, sodium phosphate, potassium phosphate, potassium triphosphate, sodium triphosphate, or any combination thereof.

37. The method of claim 33, wherein the phosphate salt is added to the fibers in a range between about 0.01 wt. % and about 2 wt. % based on the total weight of the mixture.

38. The method of claim 27, further exposing the brightened fibers to at least a second brightening agent.

39. The method of claim 38, wherein the at least second brightening agent is selected from the group consisting of a peroxide compound, an alkaline compound, a reducing agent, or any combination thereof.

40. The method of claim 39, wherein the peroxide compound is hydrogen peroxide.

41. The method of claim 39, further comprising exposing the brightened fibers to oxygen gas.

42. The method of claim 27, further comprising exposing the brightened fibers to a peroxide compound and then a reducing agent.

43. The method of claim 27, further comprising forming a nonwoven fabric comprising the brightened fibers.

44. The method of claim 43, wherein the nonwoven fabric is selected from the group consisting of a wet wipe, a dry wipe, or an impregnated wipe.

45. The method of claim 43, wherein the nonwoven fabric is selected from the group consisting of a tissue, a facial tissue, a bath tissue, a baby wipe, a personal care wipe, a personal protective wipe, a cosmetic wipe, a perinea wipe, a disposable washcloth, a kitchen wipe, an automotive wipe, a bath wipe, a hard surface wipe, a cleaning wipe, a disinfecting wipe, a glass wipe, a mirror wipe, a leather wipe, an electronics wipe, a lens wipe, a polishing wipe, a medical cleaning wipe, or a disinfecting wipe.

46. The method of claim 27, further comprising forming a tissue or a paper comprising the brightened fibers.

* * * * *